US012247458B2

(12) United States Patent
Jacob

(10) Patent No.: US 12,247,458 B2
(45) Date of Patent: Mar. 11, 2025

(54) METHOD AND APPARATUS FOR PROVIDING A BALL-IN-PLACE PLUG ACTIVATED BY CUP AND INTERNAL CONTINUOUS EXPANSION MECHANISM

(71) Applicants: Robert Jacob, Blois (FR); Régine Jacob, Blois (FR)

(72) Inventor: Gregoire Max Jacob, Houston, TX (US)

( * ) Notice: Subject to any disclaimer, the term of this patent is extended or adjusted under 35 U.S.C. 154(b) by 0 days.

(21) Appl. No.: 17/981,351

(22) Filed: Nov. 4, 2022

(65) Prior Publication Data

US 2023/0056451 A1 Feb. 23, 2023

Related U.S. Application Data

(63) Continuation-in-part of application No. 17/275,509, filed on Mar. 11, 2021, now Pat. No. 11,879,303.

(51) Int. Cl.

| | |
|---|---|
| ***E21B 33/134*** | (2006.01) |
| ***E21B 23/01*** | (2006.01) |
| ***E21B 23/04*** | (2006.01) |
| ***E21B 23/06*** | (2006.01) |
| ***E21B 33/12*** | (2006.01) |
| ***E21B 33/128*** | (2006.01) |
| ***E21B 33/129*** | (2006.01) |
| ***E21B 33/1295*** | (2006.01) |

(52) U.S. Cl.

CPC ..... *E21B 33/134* (2013.01); *E21B 23/01* (2013.01); *E21B 23/06* (2013.01); *E21B 33/1208* (2013.01); *E21B 33/128* (2013.01); *E21B 33/129* (2013.01); *E21B 23/0411* (2020.05); *E21B 23/0413* (2020.05); *E21B 33/1295* (2013.01); *E21B 2200/08* (2020.05)

(58) Field of Classification Search

CPC ..... E21B 33/134; E21B 23/01; E21B 23/06; E21B 33/1208; E21B 33/128; E21B 33/129; E21B 2200/08; E21B 23/0411; E21B 23/0413; E21B 33/1295

See application file for complete search history.

(56) References Cited

U.S. PATENT DOCUMENTS

| | | | |
|---|---|---|---|
| 2,331,532 | A | 8/1940 | Bassinger |
| 5,131,468 | A | 7/1992 | Lane et al. |
| 5,819,846 | A | 10/1998 | Bolt, Jr. |
| 5,984,007 | A | 11/1999 | Yuan et al. |

(Continued)

*Primary Examiner* — Robert E Fuller
*Assistant Examiner* — Neel Girish Patel
(74) *Attorney, Agent, or Firm* — Blair B. Suire

(57) ABSTRACT

A plug assembly, dedicated for ball-in-place operation, includes an expandable assembly, a locking ring, a cup and studs, to be deployed using a retrievable setting tool. The expandable assembly is adapted to be deformed radially over the locking ring and the cup, while the locking ring is retained longitudinally relative to a mandrel of the retrievable setting tool, thanks to the studs positioned within the cup. The locking ring has a stopping inner surface. The combination of the cup and an untethered object is adapted to contact an inner surface of the plug assembly and, using well fluid pressure, to apply forces to the plug assembly. The forces cause the longitudinal movement of the cup and untethered objects while contacting the inner surface of the plug assembly until the cup contacts the stopping inner surface of the locking ring.

18 Claims, 13 Drawing Sheets

(56) References Cited

U.S. PATENT DOCUMENTS 6,220,349 B1 4/2001 Vargus et al.
6,394,180 B1 5/2002 Berscheidt
7,475,736 B2 1/2009 Lehr et al.
7,510,018 B2 3/2009 Williamson
8,579,024 B2 11/2013 Mailand et al.
8,684,096 B2 4/2014 Harris et al.
8,887,818 B1 11/2014 Carr et al.
8,997,859 B1 4/2015 Ackermann
9,027,655 B2 5/2015 Xu et al.
9,027,659 B2 5/2015 Martinez et al.
9,062,543 B1 6/2015 Snider et al.
9,080,403 B2 7/2015 Xu et al.
9,284,803 B2 3/2016 Stone et al.
9,309,733 B2 4/2016 Xu et al.
9,316,084 B2 4/2016 Carter et al.
9,316,086 B2 4/2016 Van Lue
9,382,787 B2 7/2016 Naedler
9,732,579 B2 8/2017 Hiorth et al.
9,752,407 B2 9/2017 Jacob
9,835,003 B2 * 12/2017 Harris ..... E21B 33/1208
9,976,381 B2 5/2018 Martin et al.
9,988,867 B2 6/2018 Jacob et al.
10,066,453 B2 9/2018 Silva
10,385,651 B2 * 8/2019 Smith ..... E21B 23/01
10,408,012 B2 * 9/2019 Martin ..... E21B 33/1277
10,472,927 B2 11/2019 Marcin et al.
10,508,526 B2 12/2019 Ring
10,648,275 B2 5/2020 Dirocco
10,662,732 B2 5/2020 Frazier
10,724,311 B2 7/2020 Parekh et al.
10,794,142 B2 10/2020 Stone et al.
11,002,104 B2 * 5/2021 Wolf ..... E21B 33/128
11,021,927 B2 6/2021 Hiorth
11,047,186 B2 6/2021 Ng et al.
11,072,991 B2 7/2021 Martin et al.
11,125,045 B2 9/2021 Hern et al.
11,274,525 B2 3/2022 Kratochvil
11,396,787 B2 7/2022 Kellner et al.
11,408,245 B2 8/2022 Dudzinski
11,428,089 B2 8/2022 Winkler et al.
11,434,717 B2 9/2022 Jacob
11,492,867 B2 11/2022 Yuan et al.
2003/0188876 A1 * 10/2003 Vick ..... E21B 33/1208 166/134
2004/0079528 A1 * 4/2004 Metcalfe ..... E21B 7/20 166/55
2013/0008671 A1 * 1/2013 Booth ..... E21B 33/128 166/135
2013/0186647 A1 * 7/2013 Xu ..... E21B 33/129 166/207
2013/0186650 A1 * 7/2013 Xu ..... E21B 23/01 166/386
2013/0206409 A1 * 8/2013 Stone ..... E21B 43/261 166/135
2014/0262344 A1 * 9/2014 Standridge ..... E21B 33/129 166/208
2016/0047195 A1 2/2016 Snider
2016/0186511 A1 6/2016 Coronado
2016/0273299 A1 * 9/2016 Fripp ..... E21B 33/128
2016/0369582 A1 * 12/2016 Bar ..... E21B 23/02
2016/0376869 A1 * 12/2016 Rochen ..... E21B 43/116 166/135
2017/0145781 A1 * 5/2017 Silva ..... E21B 23/06
2018/0135380 A1 * 5/2018 Saulou ..... E21B 33/128
2018/0148993 A1 * 5/2018 Schmidt ..... E21B 33/1291
2018/0171748 A1 * 6/2018 Hou ..... E21B 33/1293
2018/0274325 A1 * 9/2018 Greenlee ..... E21B 33/128
2019/0106961 A1 * 4/2019 Hardesty ..... E21B 33/128
2019/0203557 A1 * 7/2019 Dirocco ..... E21B 33/129
2019/0292874 A1 * 9/2019 Saeed ..... E21B 33/1293
2019/0309598 A1 * 10/2019 Cheng ..... E21B 33/128
2020/0347694 A1 * 11/2020 Power ..... E21B 23/06
2021/0238950 A1 * 8/2021 Keeling ..... E21B 33/128
2021/0310338 A1 10/2021 Turley et al.
2021/0332661 A1 * 10/2021 Tonti ..... E21B 34/14
2021/0381334 A1 * 12/2021 Goodman ..... E21B 33/128

* cited by examiner

METHOD AND APPARATUS FOR PROVIDING A BALL-IN-PLACE PLUG ACTIVATED BY CUP AND INTERNAL CONTINUOUS EXPANSION MECHANISM

CROSS-REFERENCE TO RELATED APPLICATION

The present application is a Continuation-In-Part (CIP) application of U.S. application Ser. No. 17/275,509 filed Mar. 11, 2021, titled "Methods and Apparatus for providing a plug with a two-step expansion" naming Gregoire M Jacob as inventor. All the foregoing applications are hereby incorporated herein by reference in their entirety.

BACKGROUND

This disclosure relates generally to methods and apparatus for providing a plug inside a tubing string containing well fluid. This disclosure relates more particularly to methods and apparatus for providing a plug including a carried untethered object, or Ball-In-Place plug.

The first figure (FIG. 1) refers to one environment example in which the methods and apparatus for providing a plug inside a tubing string containing well fluid, described herein, may be implemented and used.

FIG. 1 illustrates a typical cross section of an underground section dedicated to a cased-hole operation. The type of operation is often designated as Multi-Stage-Stimulation, as similar operations are repeatedly performed inside a tubing string in order to stimulate the wellbore area.

The wellbore may have a cased section, represented with tubing string 1. The tubing string contains typically several sections from the surface 3 until the well end. The tubing string represented schematically includes a vertical and horizontal section. The entire tubing string contains a well fluid 2, which can be pumped from surface, such as water, gel, brine, acid, and also coming from downhole formation such as produced fluids or condensates, like water and hydrocarbons in liquid or gas form. The surface 3 may represent a ground surface, typically for land operations, or a seabed surface, typically for offshore operations.

The tubing string 1 can be partially or fully cemented, referred as cemented stimulation, or partially or fully free within the borehole, referred as open-hole stimulation. Typically, a stimulation will include temporary or permanent section isolation between the formation and the internal volume of the tubing string.

The bottom section of FIG. 1 illustrates several stimulation stages starting from well end. In this particular well embodiment, at least stages 4*a*, 4*b*, 4*c* have been stimulated and isolated from each other. The stimulation is represented with fluid penetration inside the formation through fracturing channels 7, which are initiated from a fluid entry point inside the tubing string. This fluid entry point can typically come from perforations or sliding sleeves openings.

Each isolation includes a set plug 6 with its untethered object 5, represented as a spherical ball as one example.

The stimulation and isolation are typically sequential from the well end, from downhole to uphole. At the end of stage 4*c*, after its stimulation 7, another isolation and stimulation, represented as subsequent stage 4*d*, may be performed in the tubing string 1.

In this representation, a toolstring 10 is conveyed via a cable or wireline 9, which is controlled by a surface unit 8. Other conveyance methods may include tubing conveyed toolstring or coiled tubing. Along with a cable, a combination of gravity, tractoring and pump-down may be used to bring the toolstring 10 to the desired position inside the tubing string 1. The toolstring 10 may convey an unset plug 11, dedicated to isolating stage 4*c* from stage 4*d*.

Additional pumping rate and pressure may create a fluid stimulation 7 inside the formation located on or near stage 4*d*. When the stimulation is completed, another plug may be set and the overall sequence of stages 4*a* to 4*d* may start again. Typically, the number of stages within a wellbore may be between 10 and 100, depending on the technique used, the length of the well and spacing of each stage.

There is a continuing need in the art for methods and apparatus for methods and apparatus for providing a plug inside a tubing string containing well fluid. Preferably, the plug is provided using a 2-step ball contact, first with one or more deformable plug components, second with one or more rigid plug components.

BRIEF DESCRIPTION OF THE DRAWINGS

For a more detailed description of the embodiments of the disclosure, reference will now be made to the accompanying drawings.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

A reference to U.S. application Ser. No. 17/275,509 filed Mar. 11, 2021, titled "Methods and Apparatus for providing a plug with a two-step expansion" can provide a detailed description of the FIGS. 2 to 5. A quick background reference is done in this US application, as several embodiments are the same compared to the new US application as CIP with the improvement further described in FIGS. 6 to 25.

Figure 2:
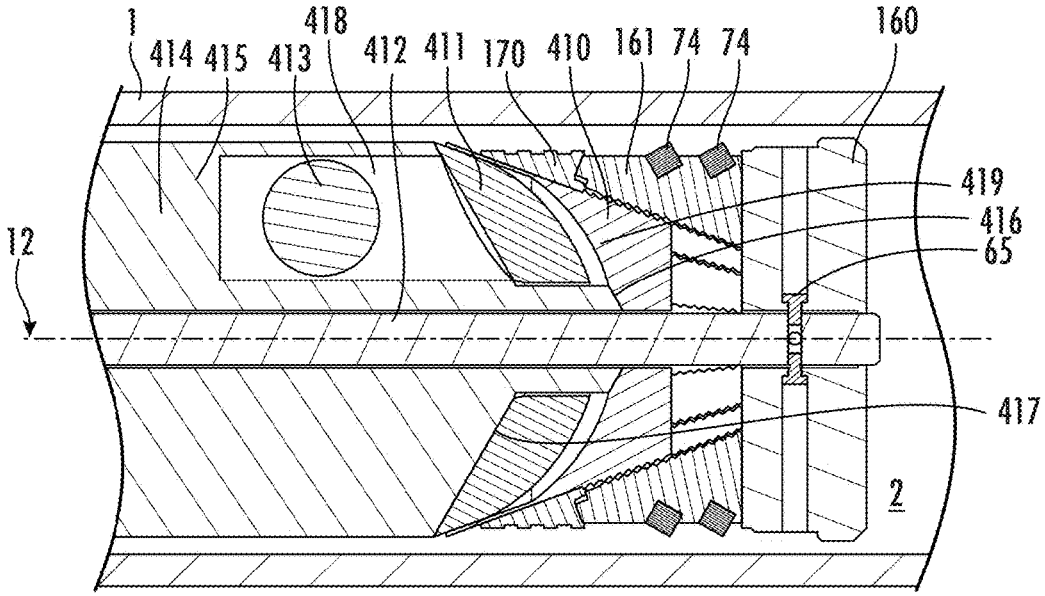
FIG. 2 is a cross-section view of an embodiment of a plug assembly, in a run-in hole position inside a tubing string, over a setting tool having a caged untethered object or ball-in-place.

FIG. 2 represents a cut view of an unset plug or run-in-hole plug, inside the tubing string 1, along a tool axis 12. FIG. 2 represents the unactuated or undeformed position for the plug and a retrievable setting tool, which allows traveling inside the tubing string 1.

The plug may include the following components:

an expandable continuous seal ring 170, an expandable gripping ring 161, which preferably includes anchoring devices 74, a back-pushing ring 160, including shear devices 65 which may be positioned on the inner diameter of the back-pushing ring 160, a locking ring 410, which includes a conical external shape matching the inner surface of the expandable gripping ring 161 and the inner surface of the expandable continuous seal ring 170. The locking ring 410 may include a hemispherical inner surface 419 and a conical inner surface 416, and, a hemispherical cup 411.

The retrievable setting tool may include the following components:

an external mandrel 414, which may include a cylindrical pocket 418. The pocket 418 may have a channel 415 linking the pocket 418 with the well fluid 2 present inside the tubing string 1. In this representation, the external mandrel 414 may contact the locking ring 410 along the conical surface 416. In addition, the external mandrel 414 may contact the hemispherical cup 411 along a conical surface 417, a rod 412 which can move longitudinally within the external mandrel 414. The rod 412 may provide a link to the shear devices 65, securing the longitudinal position of the back-pushing ring 160.

In addition, an untethered object 413 may be included inside the pocket 418 of the external mandrel 414.

This embodiment may be referred to as 'ball in place', where the untethered object 413 may be a ball which is included in the retrievable setting tool. Other embodiments for the untethered object 413 may be a pill, a dart, a plunger, preferably at least a hemispherical or conical shape. Alternatively, the untethered objects 413 and 313 can be pumped or launched from surface inside the tubing string.

Figure 3:
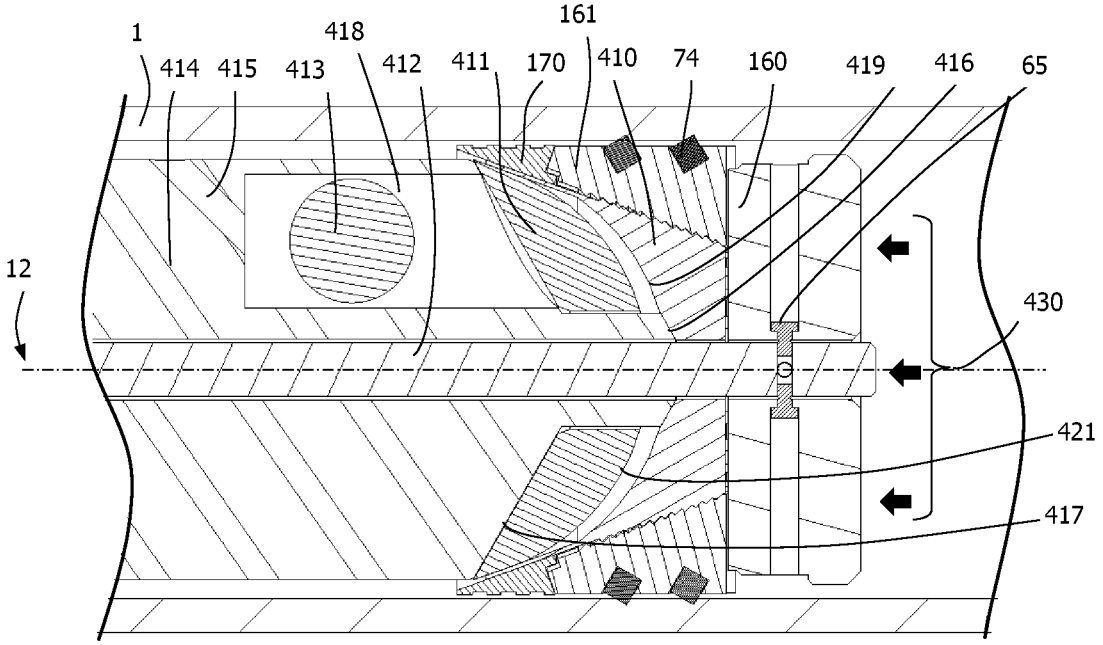
FIG. 3 is a cross-section view of a plug assembly, in a set position inside a tubing string, over a setting tool having a caged untethered object or ball-in-place.

FIG. 3 represents a sequential step of FIG. 2. In FIG. 3, the retrievable setting tool has been actuated, which induces the longitudinal movement indicated by arrow 430 of the rod 412 relative to the external mandrel 414.

Through the connection of the shear devices 65 with the rod 412, the movement of the rod 412, indicated by arrow 430, may induce the same longitudinal movement as the back-pushing ring 160. The back-pushing ring may induce in turn an expansion movement to the expandable gripping ring 161, which in turn induces an expansion movement through the deformation of the continuous expandable seal ring 170. The expansion of the expandable gripping ring 161 and of the continuous expandable seal ring 170 occurs both longitudinally and radially over the conical external shape of the locking ring 410. The locking ring is held longitudinally in position thanks to the contact 416 with the external mandrel 414, as well as radially in position through the conical contact with the hemispherical cup 411, itself held in position through the conical contact 417 with the external mandrel. To be noted during this expansion process, the hemispherical surface 419 of the locking ring 410 may not come in contact with the hemispherical surface 421 of the hemispherical cup 411, keeping a longitudinal gap.

The expansion process of the expandable gripping ring may end when one of the anchoring devices 74 start penetrating inside the inner surface of the tubing string 1, and a force equilibrium is established between the anchoring force or friction force created by the anchoring devices 74 with the shear devices 65.

At this point, the expandable continuous seal ring 170 might not be in contact with the inner surface of the tubing string 1. This can be due to possible stop of the expansion process of the expandable continuous seal ring 170 before reaching the inner surface contact with the tubing string 1, and possible elastic restraint effect of the different parts after the setting process as described in FIG. 3.

As depicted in FIG. 3, the untethered object 413 may still remain inside the cylindrical pocket 418 of the external mandrel 414.

The hemispherical cup 411 may stay in its longitudinal position thanks to the friction contact along its conical surface 420 in common with the inner conical surface of the locking ring 410, or thanks to a clipping mechanism with the locking ring 410.

Figure 4:
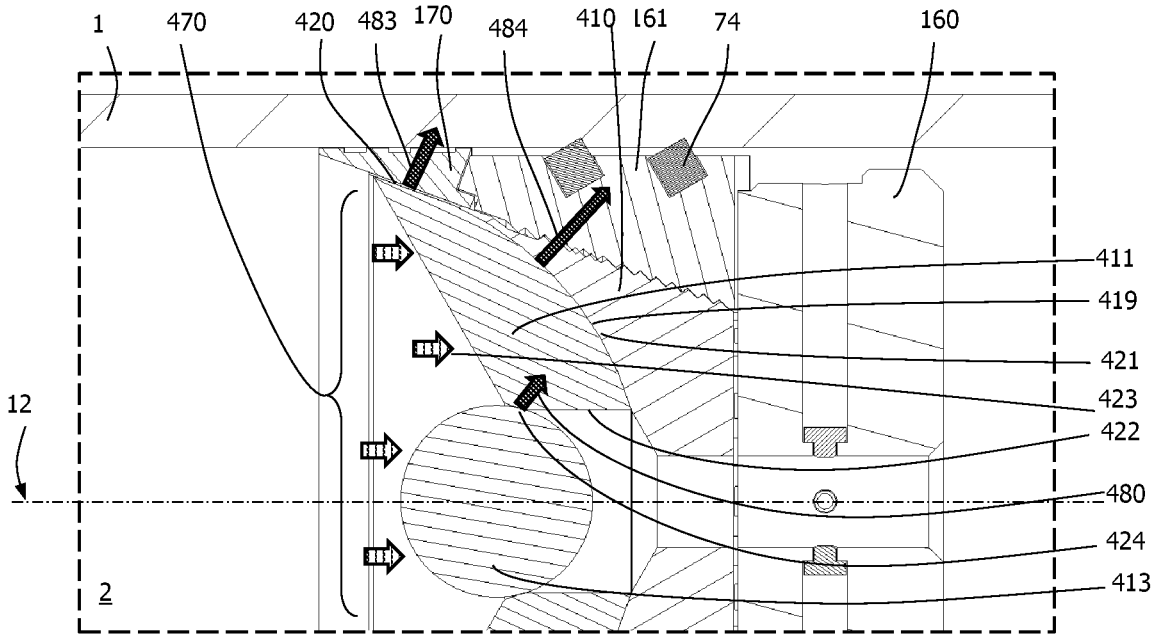
FIG. 4 is a detailed cross-section view of a plug assembly, in a set position, with the caged untethered object landed on the hemispherical cup and pressing on the plug assembly using well fluid pressure.

FIG. 4 depicts a close-up view of a plug assembly, in a set position, with the caged untethered object landed on the hemispherical cup and pressing on the plug assembly using well fluid pressure.

As depicted in FIG. 4, the untethered object 413 has landed on the hemispherical cup 411 and may contact the chamfer 424.

A well fluid 2 may be pumped from uphole of the set plug, creating a flow restriction and in turn a local pressure uphole of the set plug and a force 470 on the uphole exposed plug components. The force 470 may act mainly on the untethered object 413 and the hemispherical cup 411.

As depicted in FIG. 4, the force 470 may induce a further longitudinal movement of the hemispherical cup 411 and the untethered object 413. The longitudinal movement of the hemispherical cup may in turn create a radial deformation of the locking ring 410 through its inner conical surface 420, which in turn may create a further radial deformation of the expandable continuous seal ring 170.

The further longitudinal movement may continue up to surface contact of the hemispherical surface 421 of the hemispherical cup 411 together with the corresponding surface 419 on the locking ring 410.

The force 470 is acting on the untethered object 413 and on the hemispherical cup 411, with the two parts being in contact through a chamfer 424 and providing a force indicated by arrow 480 at this contact surface. The resultant force indicated by arrow 481 of these two parts may be directed perpendicular to the conical contact surface 420 with the locking ring 410.

The expandable gripping ring 161 secured with the anchoring devices 74 inside the tubing string 1 and locked internally by the locking ring 410, may not deform during the further expansion process of the expandable continuous ring 170, and provide a radial sliding guide.

Having the hemispherical cup 411 in contact with the locking ring 410, the resultant of the force 470 on the untethered object 413 and on the hemispherical cup 411, may now directed towards forces 483 and 484. Force 483 may compress the expandable continuous seal ring 170 further towards the tubing string, possibly enhancing the sealing feature of the plug. Force 484 may compress the expandable gripping ring 161 further towards the tubing string via the anchoring devices 74, possibly enhancing the anchoring feature of the plug.

Figure 5:
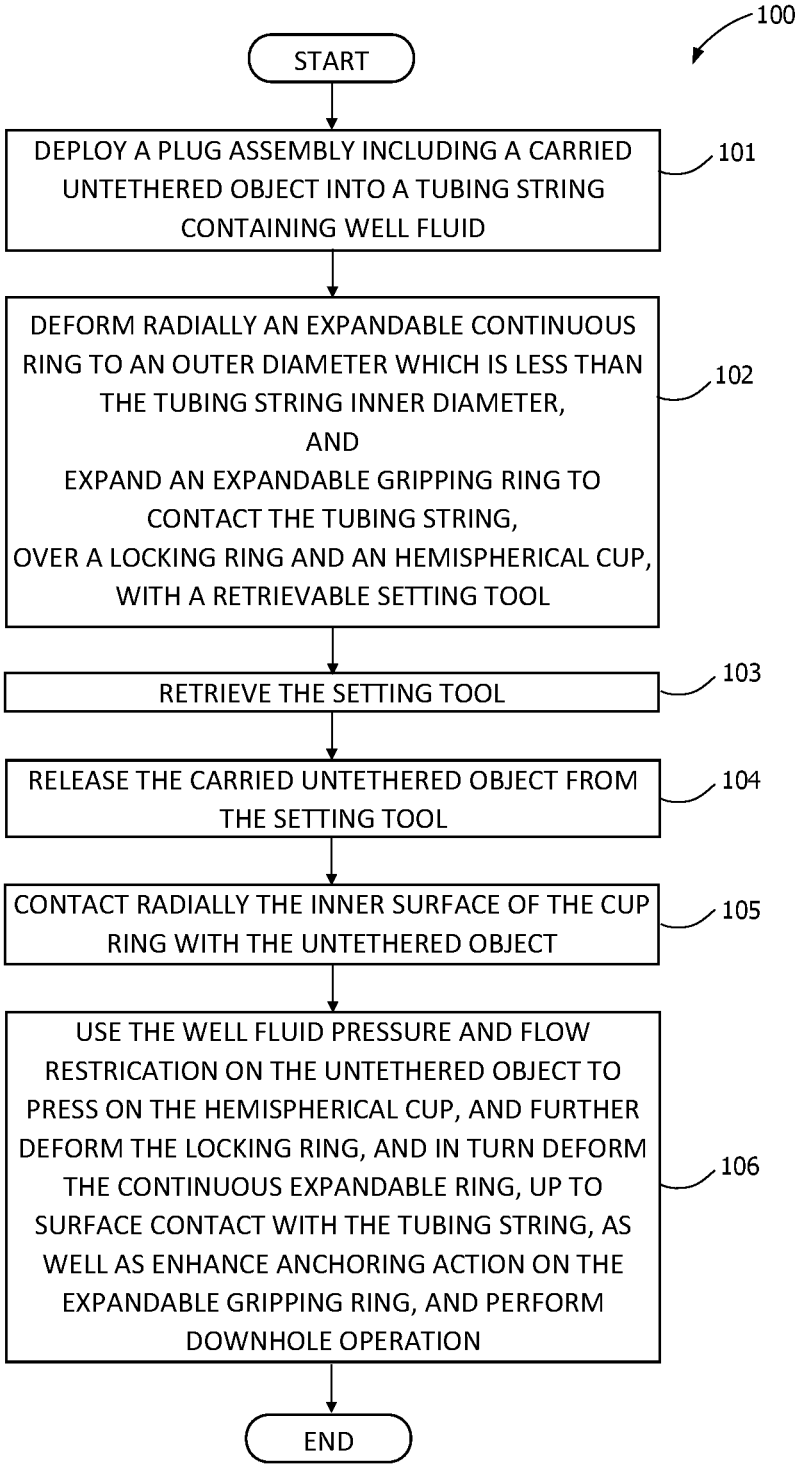
FIG. 5 is a flow diagram representing a technique sequence of deploying a plug assembly with a caged untethered object and hemispherical cup having the action of further expanding the expandable assembly and contacting a stopping surface on the locking ring.

FIG. 5 represents a technique sequence 100, which includes major steps depicted in FIG. 2 to FIG. 4.

Step 101 corresponds to the deployment of a plug assembly (170, 410, 411, 161, 160) including a carried untethered object (413) into the tubing string (1) containing well fluid (2). During step 102, the plug assembly with its expandable continuous seal ring (170) is deformed radially, and the expandable gripping ring (161) is expanded radially, both due to the action of a retrievable setting tool, over a locking ring (410) and hemispherical cup (411). During the same step 102, the expandable gripping ring contacts at least one point of the inner surface of the tubing string (1), while the expandable continuous seal ring (170) is deformed to an outer diameter which may be less than the tubing string (1) inner diameter. Then, during step 103, the retrievable setting tool, is retrieved. Further during step 104, the carried untethered object (413), is released from the setting tool. Then, during step 105, the untethered object (413) contacts radially the inner surface of the hemispherical cup (411). Then, during step 106, the well fluid (2) pressure and flow restriction up-hole of the untethered object (413) and hemispherical cup (411) is used to act as a force to deform further the expandable continuous seal ring (170), up to its outer surface contact with the tubing string (1) inner surface, allowing further enhanced contact between all plug components from the untethered object (413) to the tubing string (1) passing through the hemispherical cup (411), the locking ring (410) and the expandable continuous seal ring (170). The same force may also enhance the anchoring action on the expandable gripping ring (161). This isolation state allows performing a downhole operation inside the well.

Thus, the disclosure describes a method comprising the step of providing a plug assembly. The plug assembly may include an expandable assembly, and a locking ring. The expandable assembly may comprise a continuous sealing portion and a gripping portion. The locking ring may include a flared outer surface and a stopping inner surface. The flared outer surface of the locking ring may be contacting the flared inner surface of the expandable assembly. The plug assembly may further include an inner surface. The method comprises the step of providing a cup. The cup may include an outer surface that is coupled to the inner surface of the plug assembly. The outer surface of the cup may be adapted to couple with the stopping inner surface of the locking ring. The method comprises the step of deploying the plug assembly and the cup into a tubing string containing well fluid. The method comprises the step of expanding the expandable assembly over the flared outer surface of the locking ring, whereby the expandable assembly may deform radially, for example, until the gripping portion of the expandable assembly contacts at least one point of an internal surface of the tubing string. Radially deforming the expandable assembly may occur through plastic deformation of metallic alloy. The method comprises the step of launching or releasing, such as from surface or from a setting tool, an untethered object inside the well fluid of the tubing string. The untethered object may include an outer surface adapted to couple with the cup. The method comprises the step of contacting the untethered object with the cup, after the expandable assembly is deformed radially. The method comprises the step of applying pressure on the untethered object using the well fluid whereby forces are applied to the cup. The force may cause one or more of a radial deformation of the continuous sealing portion of the expandable assembly, a contact of an internal surface of the tubing string with the continuous sealing portion of the expandable assembly, or a longitudinal movement of the cup while contacting the flared inner surface of the plug assembly, for example, until the cup contacts the stopping inner surface of the locking ring. The method comprises the step of penetrating the internal surface of the tubing string at the at least one point with the gripping portion of the expandable assembly.

In some embodiments, the method may comprise the step of diverting a portion of the well fluid outside the tubing string, or the step of sealing a portion of the well fluid inside the tubing string with the plug assembly. The method may comprise the step of dissolving at least one component of the plug assembly, the cup, or the untethered object.

FIGS. 6 to 25 depict an embodiment for a ball-in-place plug with an internal continuous expansion mechanism, including a cup and studs.

Figure 6:
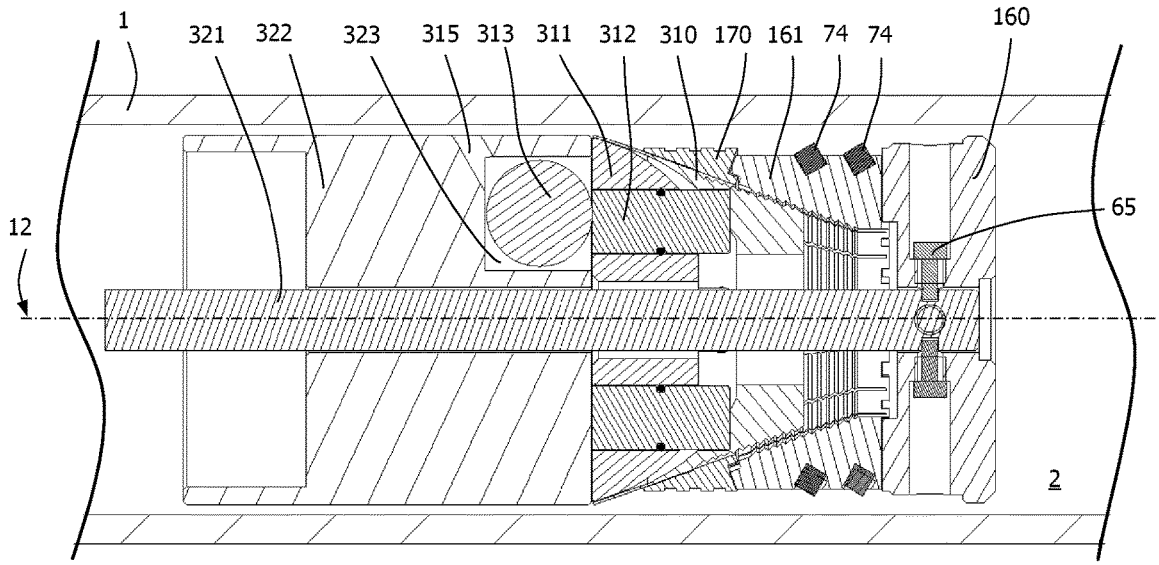
FIG. 6 is a cross-section view of a ball-in-place plug, activated by a cup and including studs. The plug is run inside a tubing string over a retrievable setting tool and is shown in an unset or conveyance position.

FIG. 6 represents a cross-section view of a ball-in-place plug in an unset position within a tubing string 1 and filled with well fluid 2. The plug may comprise the following components:

- an expandable continuous sealing ring 170
- an expandable gripping ring 161, which may include one or more anchoring devices, represented as buttons 74
- a locking ring 310
- a hemispherical cup 311
- a back-pushing ring 160
- one or more studs 312
- one or more load shearing device, represented as shear screws 65
- one carried untethered object, represented as a ball 313

The descriptions made in U.S. application Ser. No. 17/275,509 filed Mar. 11, 2021 for the continuous expandable seal ring 170, the expandable gripping ring 161, the anchoring devices 74, the back-pushing ring 160, can be taken as reference for this current CIP application.

All the plug components, 170, 161, 74, 160, 310, 311, 312, 65, including the untethered object 313 may be built out of dissolvable material. The dissolvable material may be a composite material or metallic alloy which may dissolve or decompose within the well fluid 2. The dissolving or decomposition may include an oxidation-reduction or corrosion reaction with some components of the well fluid 2.

The locking ring 310, the hemispherical cup 311, the studs 312 will be further detailed in FIGS. 18 to 24.

Figure 1:
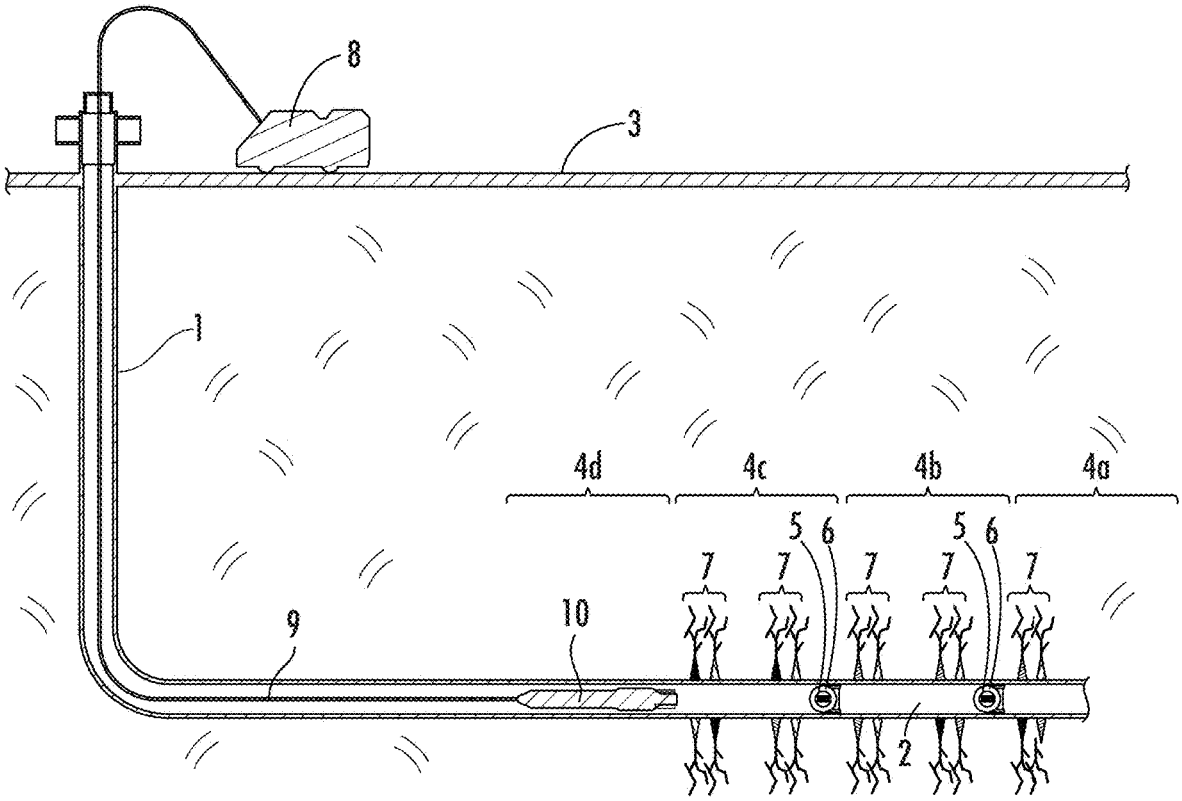
FIG. 1 is a wellbore cross-section view of typical Multi-Stage-Stimulation operation ongoing, with three stages completed and a toolstring conveyance to install the third isolation device for the fourth stage.

The plug with the above listed components may typically be conveyed on a setting adapter. The setting adapter may include two components, namely an external mandrel 322 and an internal rod 321. Both the external mandrel and internal rod may be part of the toolstring 10, as globally depicted in the background FIG. 1. The toolstring 10 may be conveyed via a wireline cable, a coiled-tubing or flexible tubing, tractoring, or pumped down independently from surface inside the well fluid 2. The toolstring 10 may include other measuring or actuating components, such as positioning or formation measurement devices, like CCL for Casing Collar Locator, GR for Gamma Ray, or any environment measurement such as pressure, temperature, resistivity, sonic, ultrasonic and any combination of the above. Typically, the toolstring 10 may also include perforating guns to create perforating channels, leading to fracturing channels 7, as depicted in FIG. 1. The toolstring 10 may also include an actuation tool which provide an actuation force, typically a longitudinal force, along axis 12, with the purpose to displace longitudinally the external mandrel 322 relative to the internal rod 321, or reversed. The actuation tool, not shown in FIG. 6, may therefore be connected to the external mandrel 322 and to the internal rod 321. The actuation tool may provide its longitudinal actuation force through different means, such as power charge, hydrostatic downhole pressure, electric motor, embedded explosive or any combination. The goal of the actuation tool may be to actuate or set the plug, such as the one depicted in FIG. 6, by longitudinally displacing the external mandrel 322 relative to the internal rod 321, after receiving a command to start the displacement. The command to start the displacement of the actuation tool may come from a wired signal to an addressable switch, a programmed signal internally inside the toolstring 10 based on a position or specific environment within the tubing string 1, a wireless signal sent from another device within the tubing string 1, a nearby tubing string or surface device communicating with the toolstring 10.

Figure 7:
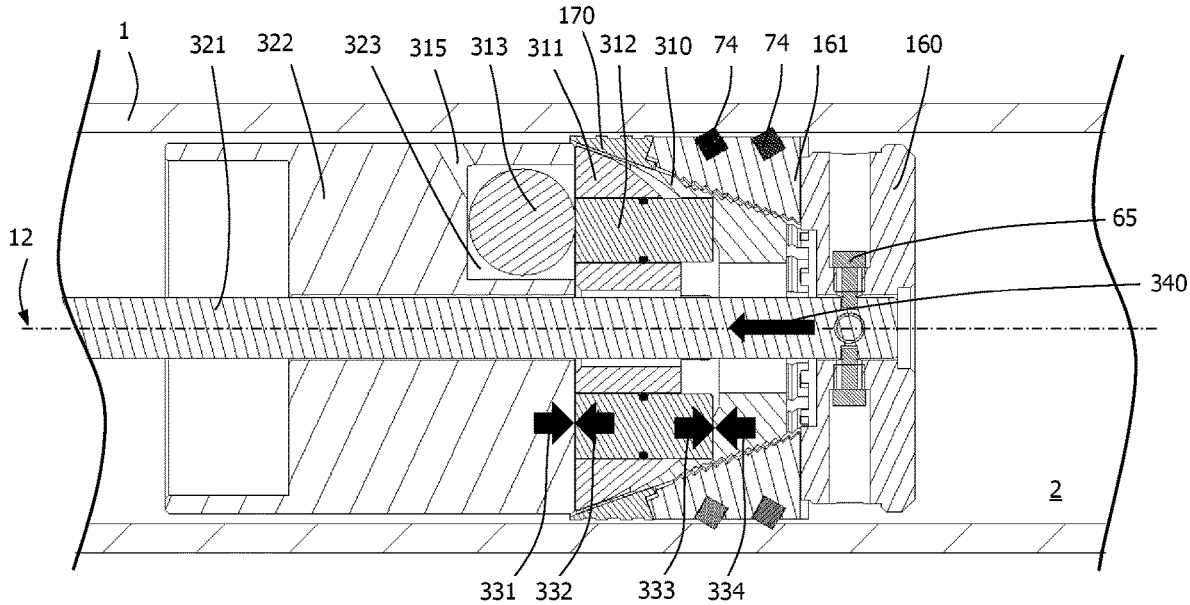
FIG. 7 is a cross-section view of the plug of FIG. 6 during setting process within the tubing string.

FIG. 7 represents a sequential step following the step described in FIG. 6. FIG. 7 depicts the same embodiment as FIG. 6 for a ball-in-place plug with an internal continuous expansion mechanism, with the plug in a set position. The actuation tool may have initiated a longitudinal movement between the internal rod 321 relative to the external mandrel 322. This longitudinal movement associated with a pulling or pushing force is symbolized with arrow 340. Note that the longitudinal movement or displacement is relative to two groups of parts and could be equally symbolized with an opposite movement of the external mandrel 322 relative to the internal rod 321.

FIG. 7 represents a cross-sectional view of the plug at the end of the setting movement. The longitudinal displacement of the internal rod 321 relative to the external mandrel 322 may include a relative displacement in the range of 0.5 in to 12 in [12.7 mm to 305 mm]. Together with the internal rod 321 movement, the back-pushing ring 160 linked with pre-loaded shearing devices 65 may induce the same longitudinal displacement. Note that the pre-loaded shearing devices 65 are represented as shear screws, though other shearing devices such as ring or studs may be included between the internal rod 321 and the back-pushing ring 160.

The longitudinal movement of the locking ring 160 may induce a longitudinal movement of the expandable gripping ring 161 relative to the locking ring 310. Due to the flared external surface of the locking ring 310 and the corresponding flared inner surface of the expandable gripping ring 161, the longitudinal movement of the expandable gripping ring 161 may include an induced radial expanding movement of the expandable gripping ring 161.

The continuous expandable seal ring 170 may have a longitudinal contact with the expandable gripping ring 161, as well as a flared inner surface corresponding to the external flared outer surface of the locking ring 310. With the longitudinal movement of the internal rod 321, the back-pushing ring 160 and the expandable gripping ring 161, the continuous expandable sealing ring 170 may follow the same movement, namely a longitudinal displacement together with a radial expansion along the flared outer surface of the locking ring 310.

The locking ring 310 may not follow the same longitudinal movement as parts 321, 160, 161 and 170, as the locking ring 310 may be stopped longitudinally relative to the external mandrel 322 thanks to the one or more studs 312. The studs 312 may include two stopping surfaces on each of its extremity. One stopping surface of the stud 312 is symbolized with arrow 333 and corresponds to a similar stopping surface 334 positioned within the locking ring 310. Another stopping surface on the longitudinal opposite direction of the stud 312 is symbolized with arrow 332 and may correspond to a stopping surface 331 positioned within the external mandrel 322. Therefore, when a relative longitudinal movement is initiated between the internal rod 321 relative to the external mandrel 322, the items 161 and 170 may move longitudinally with the internal rod 321. During the longitudinal movement of the rod 321, the locking ring 310 may be stopped or blocked longitudinally relative to the rod and stay at the same longitudinal position compared to the external mandrel 322, thanks to the one or more studs 312, which ensure the longitudinal blocking movement of the locking ring 310 relative to the external mandrel 322.

An untethered object 313 such as a ball, dart or pill may be placed in an internal pocket 323 within the external mandrel 322. Depending on the position of the blocking surface 331 of the external mandrel 322 compared to the blocking surface 332 of the stud 312, the untethered object 313 may play a similar blocking surface role as surface 331, if one of the studs 312 is positioned at a corresponding rotational angle in front of the untethered object 313.

The hemispherical cup 311 may include trough-orifices which may let the longitudinal movement of the studs 312. During the plug actuation, the blocking surfaces 331, 332, 333 and 334 may not interfere with the longitudinal equilibrium of the hemispherical cup 311, and therefore the hemispherical cup 311 may not be constraint or displaced longitudinally during the plug actuation process nor during the relative movement 340 of the internal rod 321 relative to the external mandrel 322.

Figure 8:
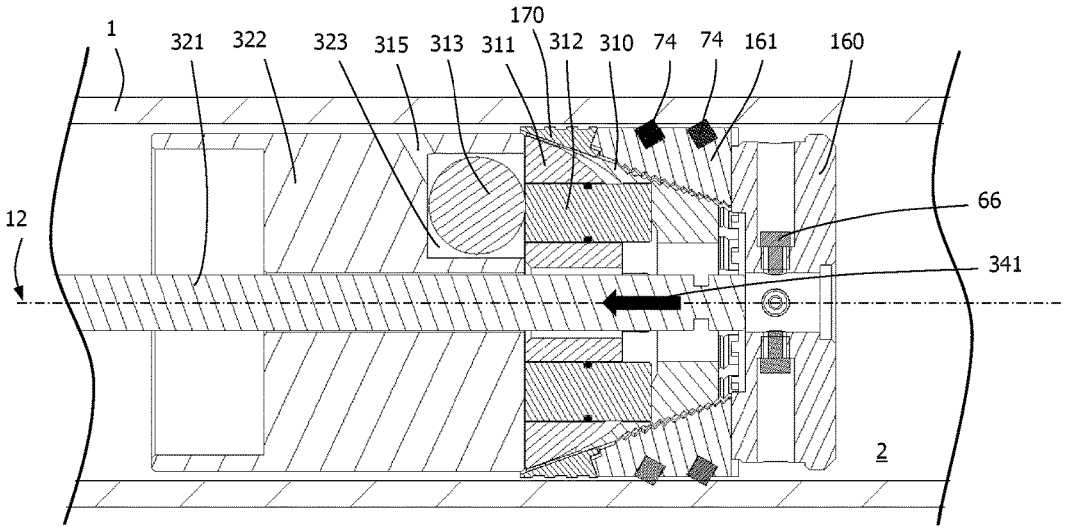
FIG. 8 is a cross-section view of the plug of FIG. 7 after set within the tubing string.

FIG. 8 is a sequential view of FIG. 7. FIG. 8 represents a cross-section view of a set plug within the tubing string 1 and depicts the position of the internal rod 321 after the shearing the pre-loaded shearing devices 65.

Sequential from FIG. 7, FIG. 8 represents the plug in a set position, wherein at least one anchoring device 74 is contacting and possibly penetrating the tubing string 1. At this point, the force and displacement induced by the relative movement of the internal rod 321 compared to the external mandrel 322 is stopped and the force is concentrated within the shearing devices 65. After reaching a force in the range of 1,000 lbf to 60,000 lbf [4450 N to 267,000 N], the shearing devices may shear and is represented as item 66 after shear in FIG. 8. The internal rod 321 may continue its longitudinal movement 341 relative to the external mandrel 322 without affecting or solicitating the other parts of the now set plug, such as items 160, 161, 170, 310, 312 and 311.

Figure 9:
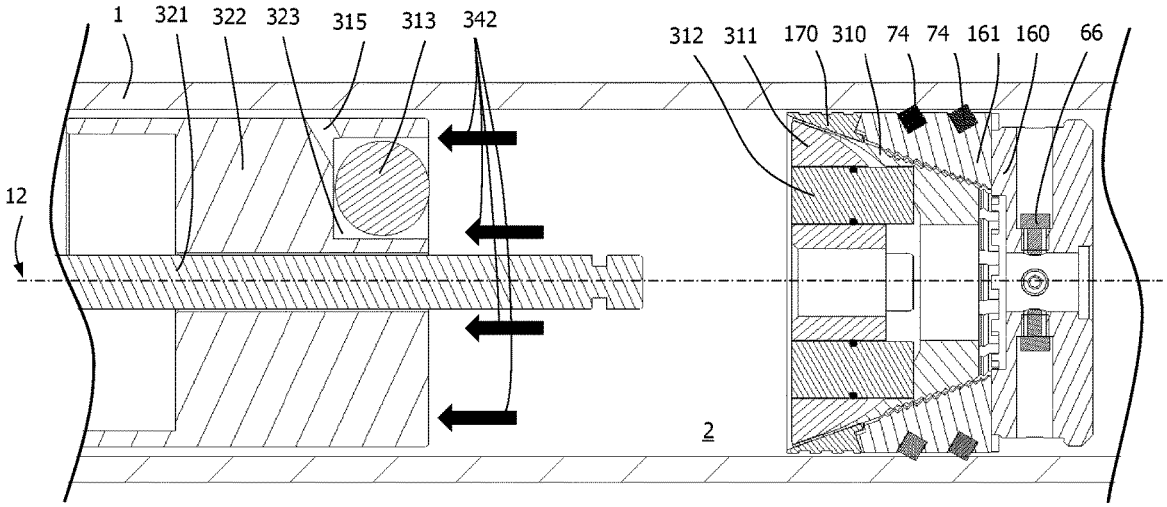
FIG. 9 is a cross-section view of the plug of FIG. 8 after set and start retrieval of the retrievable setting tool.

FIG. 9 represents a subsequent step from FIG. 8. FIG. 9 depicts a cross-sectional view of a set plug within a tubing string 1, and the releasing of the toolstring including the setting adapter with the internal rod 321 and external mandrel 322, movement symbolized with arrows 342. The releasing of the setting adapter may occur after a pulling action from surface with the device connecting the toolstring, such as a cable, a coiled-tubing or tubing conveyance. The releasing of the setting adapter may also occur from a pumping back of well fluid 2, or due to the movement self-capacity of the toolstring, such as with a tractor or turbine.

While the releasing of the setting adapter including the internal rod 321 and external mandrel 322, the untethered object 313 may be free to be released inside the well fluid 2. A flow channel 315 may contribute to the release of the untethered object 313 from the internal pocket 323 within the external mandrel 322. Other devices such as a spring may contribute to the releasing of the untethered object 313 inside the well fluid 2 and towards the set plug. The set plug with all its components, such as the back-pushing ring 160, the sheared shearing devices 66, the expandable gripping ring 161 and its anchoring devices 74, the expandable continuous sealing ring 170, the locking ring 310, the hemispherical cup 311 and the studs 312, may stay set within the tubing string 1 and not move longitudinally within the tubing string 1.

Figure 10:
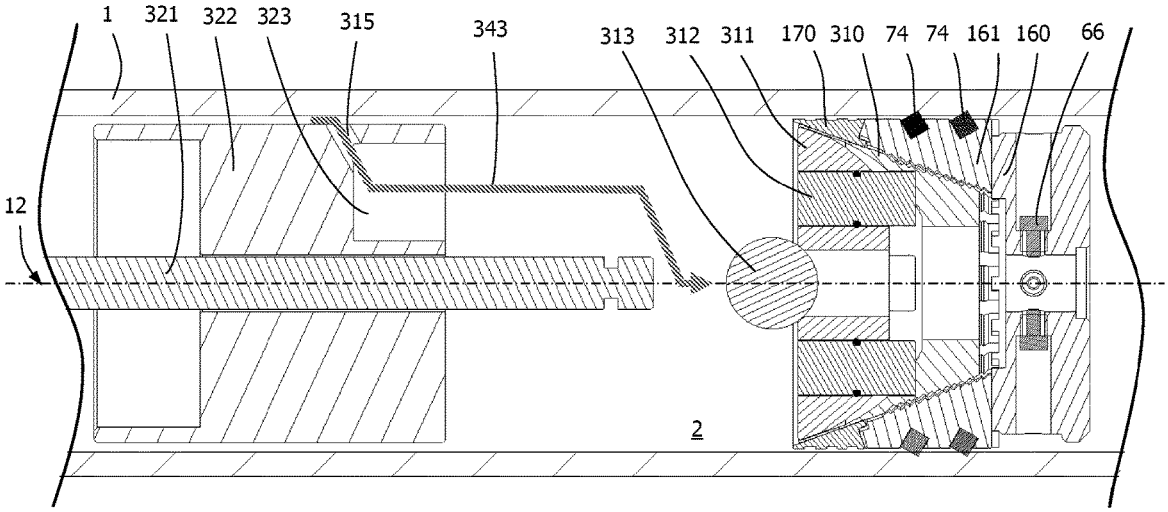
FIG. 10 is a cross-section view of the plug of FIG. 9 after release and landing of the untethered object on the cup.

FIG. 10 represents a subsequent step of FIG. 9. FIG. 10 depicts a cross-section view of the set plug within the tubing string 1, with the untethered object 313 now landed on the set plug. The untethered object 313 may follow a displacement from the internal pocket 323 of the external mandrel 322 towards a seat within the hemispherical cup 311. The arrow 343 may symbolize a fluid flow of well fluid 2 contributing to the displacement of the untethered object 313 from the external mandrel 322 towards the hemispherical cup 311. The fluid flow 343 may partially flow through the internal channel 315 of the external mandrel 322. The fluid flow 343 may occur through the internal movement of well fluid 2 within the tubing string 1, or through the pumping of well fluid 2 from surface.

Figure 11:
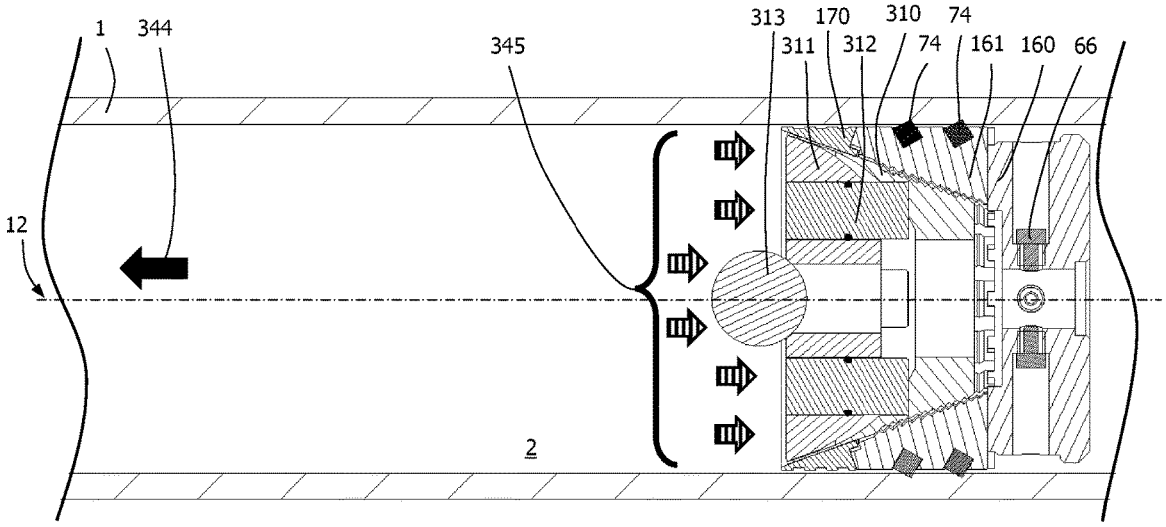
FIG. 11 is a cross-section view of the plug of FIG. 10 after pulling out of the retrievable setting tool and start creating a fluid flow barrier over the set plug inside the tubing string.

FIG. 11 represents a subsequent step of FIG. 10. FIG. 11 depicts a cross-sectional view of the set plug inside the tubing string 1 with the untethered object 313 landed on the hemispherical cup 311 of the plug. FIG. 11 shows the retrieval of the toolstring including the setting adapter which may comprise the internal rod 321 and external mandrel 322, previously depicted in FIG. 10. In FIG. 11 the toolstring retrieval is symbolized with arrow 344. The toolstring may perform other operation uphole of the set plug within the tubing string 1 and inside the well fluid 2, such as fluid, formation or tubing measurement, tubing perforation, communication to another device within the same tubing string 1 or another tubing string, or back to surface.

With the landing of the untethered object 313 on the hemispherical cup 311, the plug may provide a full or partial well fluid isolation, uphole to the set plug relative to downhole of the set plug. Further pumping of well fluid 2, symbolized with arrows 345, through the set plug, may be performed from surface or an internal well fluid 2 movement within the tubing string 1.

Figure 12:
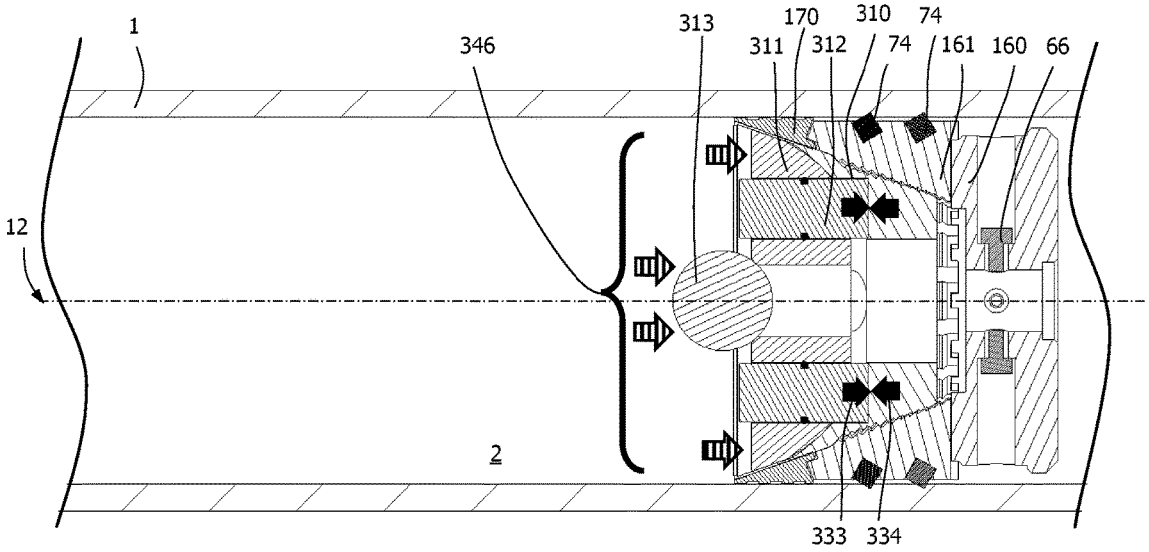
FIG. 12 is a cross-section view of the plug of FIG. 11 after pressurizing well fluid on the front plug components and inducing a longitudinal movement of some front plug components.

FIG. 12 represents a subsequent step of FIG. 11. FIG. 12 depicts a cross-sectional view of the set plug inside the tubing string 1 with the untethered object 313 landed on the hemispherical cup 311 of the plug and the flowing or pumping of well fluid 2, represented with arrows 345, as in FIG. 11. FIG. 12 shows the resultant of the flowing 345 of well fluid 2 through the set plug which is resulting in a local longitudinal force 346 due to the restricted flow of fluid within a limited flow-through area, creating a fluid pressure uphole of the restriction. The local created fluid pressure P may induce a force F on all exposed surface S, following the formula F=P/S, which is sometimes designated as a Venturi effect.

The local longitudinal force 346 may act on all surfaces exposed to the well fluid 2, uphole of the set plug. Through the geometry of the plug components which will further be detailed in FIG. 13, the force 346 may act longitudinally in particular on the untethered object 313 and the hemispherical cup 311. The studs 312 may also be exposed to the local longitudinal force 346, though may not be able to move longitudinally through the common contact of the blocking surface 333 on the studs 312 relative to the blocking surface 334 on the locking ring 310. The local longitudinal force 346 on the untethered object 131 and on the hemispherical cup 311 may include a longitudinal movement of the two parts. The longitudinal movement of the hemispherical cup 311 may deform further radially a thin section of the locking ring 310 and in turn further deform radially the expandable continuous sealing ring 170. Further details will be descripted in FIG. 13.

Figure 13:
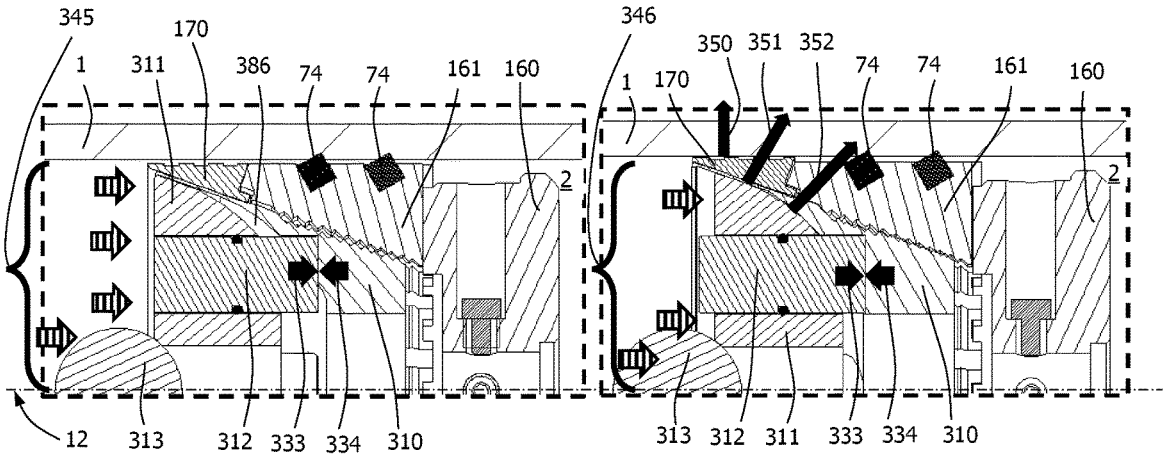
FIG. 13 represents two detailed views. The left view is a detailed view of the cross-section view of FIG. 11, and the right view is a detailed of the cross-section view of FIG. 12.

FIG. 13 represents two detailed close-up views of cross-section of the set plug. The left view of FIG. 13 represents a detailed close-up section of FIG. 11, while the right view of FIG. 13 represents a detailed close-up section of FIG. 12. Both views show about the upper half cross-section of the set plug between the center line 12 and the tubing string 1.

Left view of FIG. 13 represent the plug set inside the tubing string 1, with the expandable gripping ring 161 expanded including anchoring devices 74 in contact with the inner surface of the tubing string 1. The untethered object 313 has just landed on the dedicated opening within the hemispherical cup 311. The flowing of the well fluid 2 is represented with arrows 345 as on FIG. 11.

Right view of FIG. 13 represents the subsequent step of the left view of FIG. 13, after the well fluid flow 345 has been converted to a longitudinal force 346 on the surfaces exposed to well fluid uphole of the set plug. As explained in the description of FIG. 12, the studs 312 are prevented to move further longitudinally with the local longitudinal force 346 due to the blocking surface 333 on the stud 312 and corresponding blocking surface 334 on the locking ring 310.

A longitudinal gap 386 is represented in the left view of FIG. 13. The longitudinal gap 386 is further described in FIG. 24 including the different geometrical surfaces involved for its presence. The longitudinal gap 386 may be a gap between the outer surface of the hemispherical cup 311 and the inner surface of the locking ring 310. The longitudinal gap 386 may be retained during the plug actuation and set as depicted in FIGS. 7-8, due to presence of the studs 316 blocking the relative movement of the locking ring 310 relative to the external mandrel 322 and therefore keeping the hemispherical cup 311 free of acting forces during the actuation process. At the time of the untethered object 313 landing on the hemispherical cup 311, the longitudinal gap 386 may still be present, before the local longitudinal force 346 is acting on the hemispherical cup 311 together with the untethered object 313. On the right view of FIG. 13, the longitudinal gap 386 has been closed with the longitudinal displacement of the hemispherical cup 311 relative to the locking ring 310. The locking ring 310 may not move longitudinally due to the local longitudinal force 346, as the locking ring may be stopped longitudinally by the contact with the expandable gripping ring 161 which itself may be stopped longitudinally due to the anchoring devices 74 contacting and penetrating the tubing string 1.

The closing of the longitudinal gap 386, as shown on the right view of the FIG. 13, may be possible with the radial deformation of a thin section of the locking ring 310. Therefore, the longitudinal movement of the hemispherical cup 310 may be possible through the action of the local longitudinal force 346 up to the closing of the longitudinal gap 386 while at the same time a radial deformation, symbolized with arrow 351 occurs through the thin section of the locking ring 310. The radial deformation 351 may occur through the flared outer surface of the hemispherical cup 311 and corresponding flared thin section of the locking ring 310, The radial deformation 354 may be transmitted to the expandable continuous sealing ring 350 which may have the possibility to deform further radially towards the inner surface of the tubing string and consequently may allow a better sealing of the outer surface of the expandable continuous sealing ring 170 with the inner surface of the tubing string 1. The further radial expansion of the sealing ring 170 is symbolized with arrow 350. The further radial expansion 350 may be beneficial to improve the sealing of the plug with the tubing string 1, specially for example in situation where the sealing ring 170 is built only with a metallic alloy, resulting in a metal-to-metal sealing feature, or if the inner surface of the tubing string 1 includes some surface irregularities such as scratches or scale build-up, or also if some small particles are present inside the well fluid, such as grains of sand.

After reaching the point where the longitudinal gap 386 is closed, and further force 346 is applied on the hemispherical cup 311 and untethered object 313, the further force 346 may be finally transmitted towards the expandable gripping ring 161 and further enhance the further penetration of the anchoring devices 74 inside the inner surface of the tubing string 1. The further penetration of the anchoring devices 74 is symbolized with arrow 352. The further penetration 352 may be beneficial for the stability of the expandable gripping ring 161 and therefore of the whole plug while being solicitated with the local longitudinal force 346 which may further be completed with further greater longitudinal force due to pressure differential created from the pumping of well fluid 2 inside the tubing string 1, in order to perform an operation inside the wellbore or formation, such as fracturing, acid pumping, treating fluid pumping. Typical pressure differential uphole compared to downhole of the plug may be in the range of 1,000 to 20,000 psi [6.9 MPa to 138 MPa].

Figure 14:
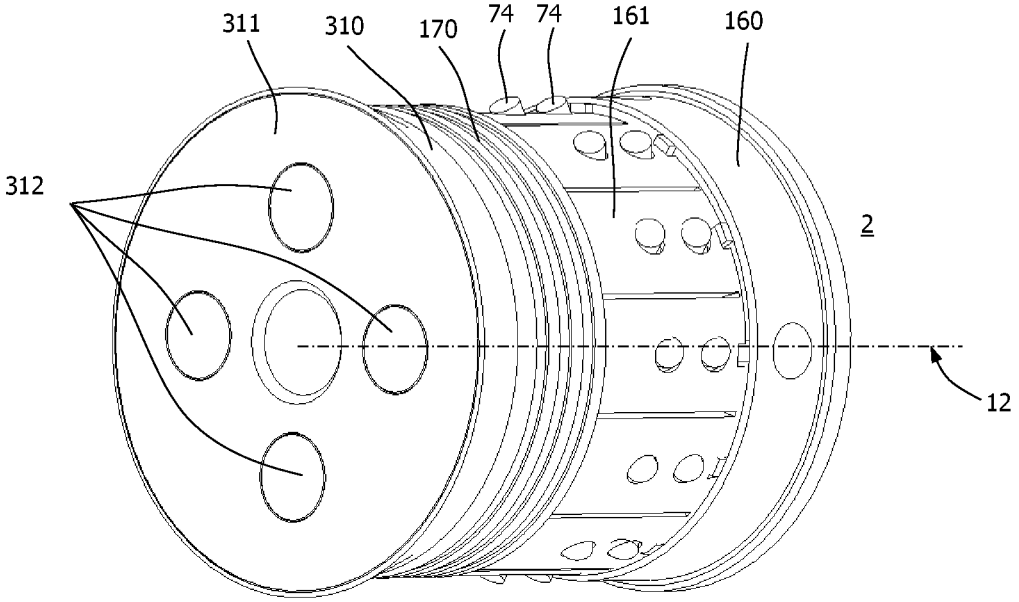
FIG. 14 is an isometric view of an unset plug including studs.

FIG. 14 represents an isometric view of a plug in an unset position, such as the one depicted in cross-section view in FIG. 6. The untethered object 313 as well the adapter kit with the internal rod 321 and external mandrel 322 are not represented in this view of FIG. 14. Visible are the hemispherical cup 311, with four studs 312. Note that other quantity of studs 312 within the hemispherical cup 311 may be possible, typically from one to twelve, and keeping the same function described in FIGS. 6-13. Also visible is the outer flared surface of the locking ring 310, the expandable continuous sealing ring 170, the expandable gripping ring 161 represented with a plurality of segments, typically a quantity between 4 and 16 segments, and included anchoring devices 74, typically between one and ten anchoring devices 74 within each segment of the expandable gripping ring 161. A back-pushing ring 160 is represented as well, the back-pushing ring 160 may be linked to pre-loaded shearing device not visible in this view. The plug may include several axisymmetric features along the axis 12. The plug may be placed in a well fluid 2. Any or all components of the plug, including the untethered object further shown in FIG. 15, may be built out of dissolving material reacting with the well fluid 2.

Figure 15:
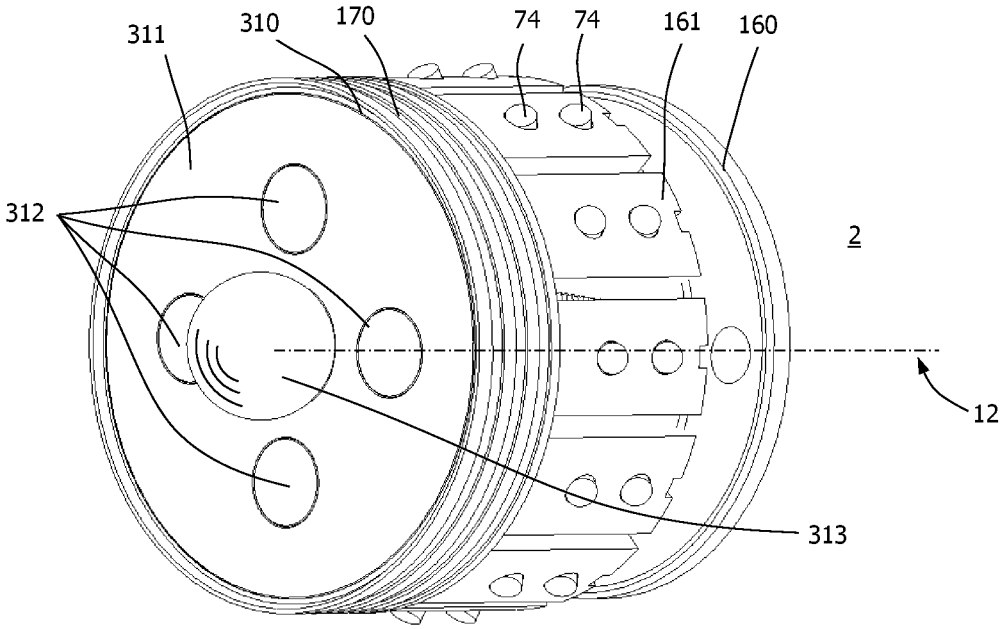
FIG. 15 is an isometric view a set plug including studs.

FIG. 15 represents an isometric view of a plug in a set position, such as the one depicted in cross-section view in FIG. 10, after the landing of the untethered object 313. The continuous expandable sealing ring 170 is now expanded over the locking ring 310. The expandable gripping ring 161 is expanded with the separation of the plurality of segments depicted in FIG. 14. The back-pushing ring 160 may be present at the back of the set plug. The studs 312 and hemispherical cup 311 may have not moved longitudinally relative to the locking ring 310 and may be in the same position as depicted in FIG. 14.

Figure 16:
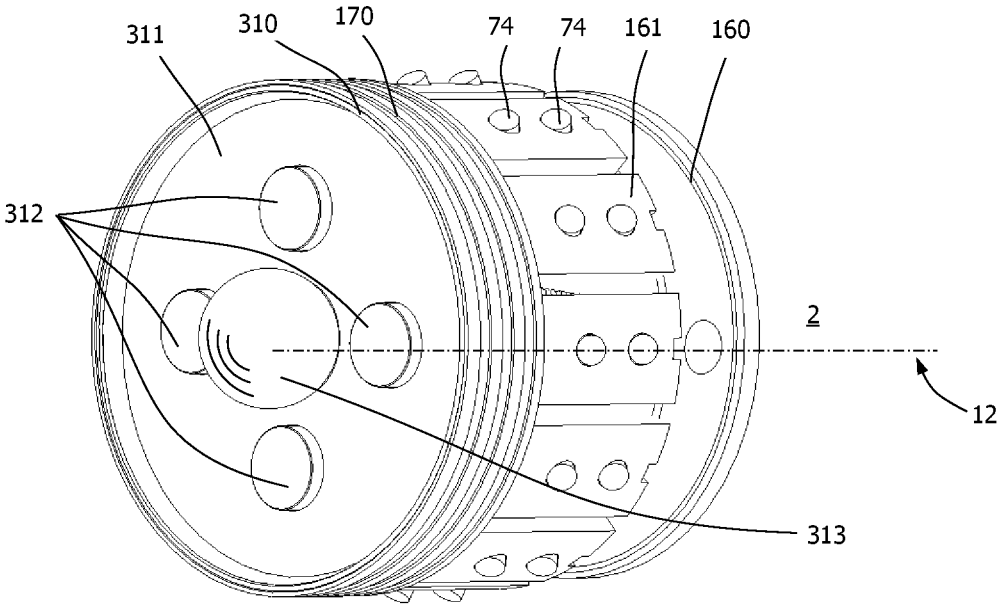
FIG. 16 is an isometric view of a set plug after applying well fluid flow restriction and induced pressure.

FIG. 16 represents an isometric view of a plug in a set position, such as the one depicted in cross-section view in FIG. 12, after the action of the local longitudinal force 346 over the hemispherical cup 311 and the untethered object 313, as described in FIG. 12. Compared to FIG. 15, the hemispherical cup 311 and untethered object 313 may have move longitudinally relative to the locking ring 310. A further expansion of the expandable continuous sealing ring 170 may have occurred as described in the right view of FIG. 13. The other components of the plug may have not noticeably moved compared to the view of FIG. 15.

Figure 17:
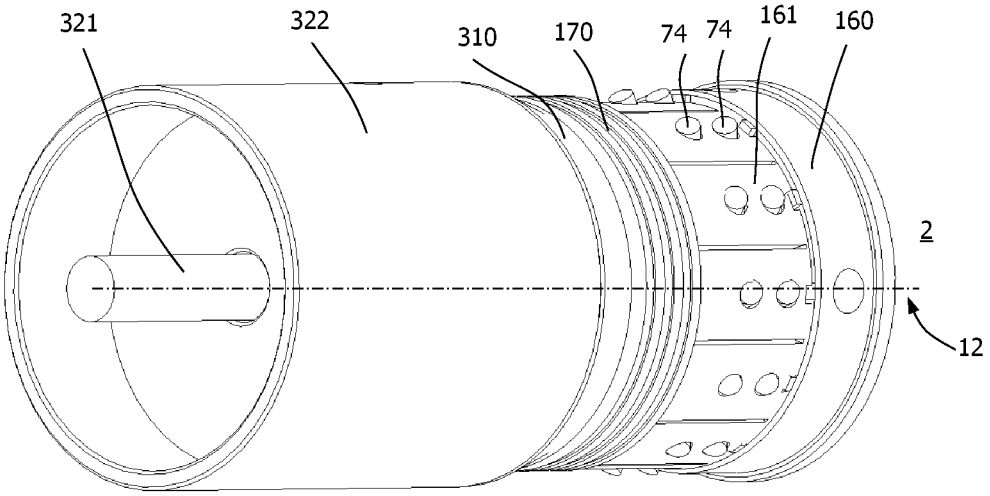
FIG. 17 is an isometric view of an unset plug including the retrievable setting tool with the setting adapter parts.

FIG. 17 represents an isometric view of an unset plug such as in FIG. 14, though from another direction view and including the setting adapter with the internal rod 321 and the external mandrel 322.

Figure 18:
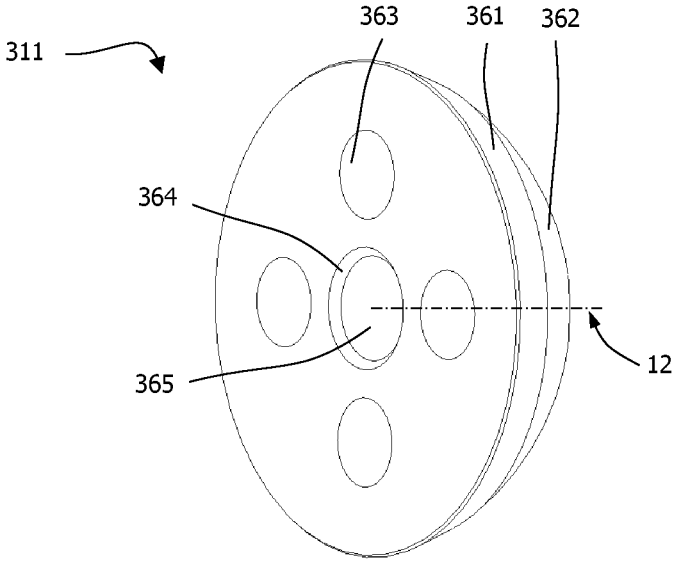
FIG. 18 is an isometric view of the hemispherical cup.
Figure 19:
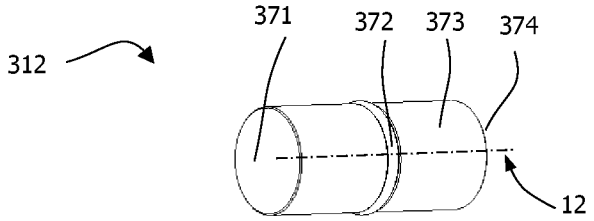
FIG. 19 is an isometric view of a stud.

FIG. 18 represents an isolated isometric view of the hemispherical cup 311, over the center axis 12. Noticeable are four orifices or through-holes 363 dedicated to fit four studs 312. Another orifice or through-hole positioned along the center axis 12 is a passage to let the internal rod 321 pass through. On the uphole side of the through-hole 364, a chamfer or seating feature may be added to fit the profile of the untethered object 313. On the downhole external face, two surfaces may be present. A first flared cup outer surface 361 may include a flared profile or angle corresponding to a first flared locking ring inner surface 381 of the locking ring 310, as further described in FIGS. 22-24. A second flared cup outer surface 362 may have a hemispherical profile corresponding to a similar second flared locking ring inner surface 382 on the locking ring 310, as further described in FIGS. 22-24.

FIG. 18 represents an isolated isometric view of the stud 312, over the center axis 12. The stud 312 may have the shape of a rod with an external surface 373 corresponding to the orifice or through-hole 363 of the hemispherical cup 311. The stud 312 may include a seal 372 such as an O-ring to improve the sealing under pressure between the surface 373 of the stud 312 and the surface 363 of the hemispherical cup 311, while ensuring a possible relative longitudinal sliding of the two parts. Two end surfaces 371 and 374 may represent the end surfaces of the rod shape and may correspond to the blocking surfaces 332 and 333 as described in FIGS. 7, 12 and 13. The end surfaces 371 and 374 may typically be flat and perpendicular to the center axis 12, though may also include a small angle or orientation features to provide an alignment and force transmission guide with the corresponding surface on the external mandrel 322, for surface 371, and with the corresponding surface 383 on the locking ring 310, for surface 374. Possible and not represented would be to include a collet or shoulder feature on either side or both sides of the two end surfaces 371 and 374. The collet feature may be added to limit the longitudinal span of longitudinal movement of the stud 312 relative to the hemispherical cup 311, in either or both directions.

Figure 20:
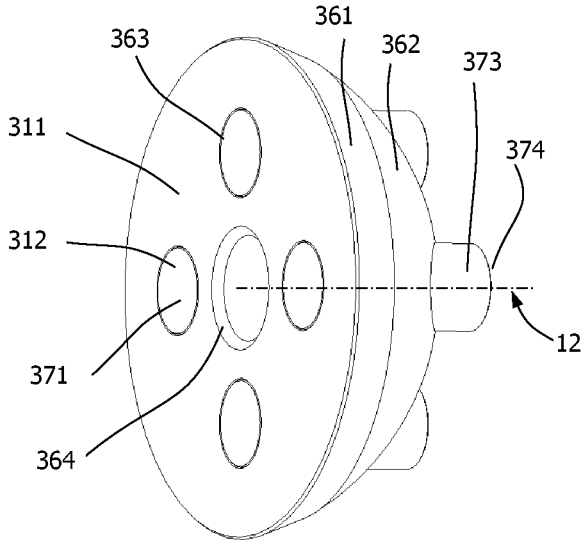
FIG. 20 is an isometric view of combination of the hemispherical cup with four studs.

FIG. 20 represents an isometric view of the combination of the hemispherical cup 311 with four studs 312. The represented position of the studs 312 relative to the hemispherical cup 311 may be the one of the unset plug as represented in FIG. 6 or FIG. 14.

Figure 21:
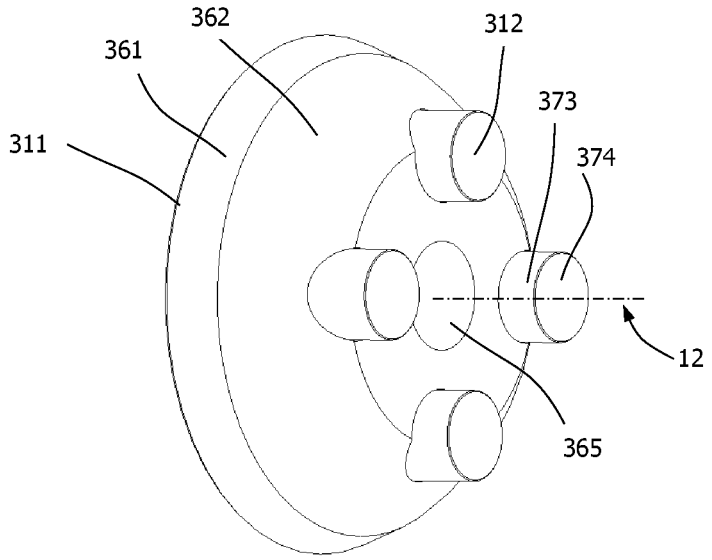
FIG. 21 is an isometric view of combination of the hemispherical cup with four studs, from another orientation compared to FIG. 20.

FIG. 21 represents an isometric view of the combination of the hemispherical cup 311 with four studs 312, towards another view point direction compared to FIG. 20.

Figure 22:
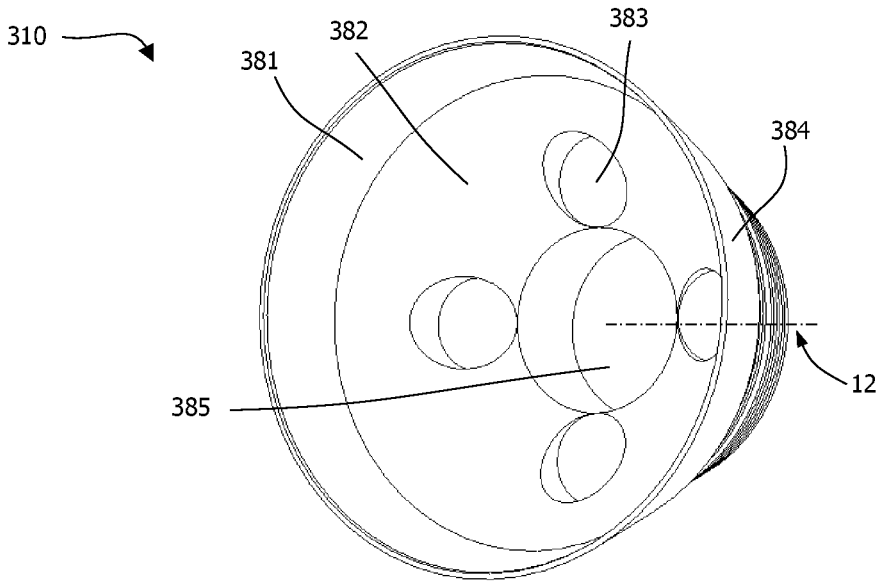
FIG. 22 is an isometric view of the locking ring.

FIG. 22 represents an isolated isometric view of the locking ring 310, over the center line 12. The locking ring 310 may include the first flared locking ring inner surface 381. The first flared locking ring inner surface 381 may be conical or hemispherical, and may have a corresponding profile as the first flared cup outer surface 361 of the hemispherical cup 311. Further downhole, the second flared locking ring inner surface 382 may be in the continuity of the first flared locking ring inner surface 381. The second flared locking ring inner surface 382 may be hemispherical or conical, with a leading angle or curvature which may be tighter or further closing compared to the leading angle of curvature of the first flared locking ring inner surface 381. A flared locking ring outer surface 384 of the locking ring 310 may have a flared profile such as conical or hemispherical. The profile of the flared locking ring outer surface 384 may correspond to the inner profile of the expandable continuous sealing ring 170 and to the inner profile of the expandable gripping ring 161. The design of the locking ring 310 may include a thin section 378, as further displayed in FIG. 23, between the first flared locking ring inner surface 381 and the flared locking ring outer surface 384, which may be in the range of 0.01 inch to 0.5 inch [0.2 mm to 12.7 mm], allowing a potential radial deformation as described in the details of FIGS. 12 and 13. The radial expansion diameter may be in the order of 1% to 30% expansion compared to the initial diameter of the thin surface.

The locking ring 310 may include one or several locking surfaces 383, which may correspond to the end surface 374 of the studs 312. A through hole 385 may be present around the center axis 12 of the locking ring 310, in order for example to keep space for the passage for the rod 321.

Figure 23:
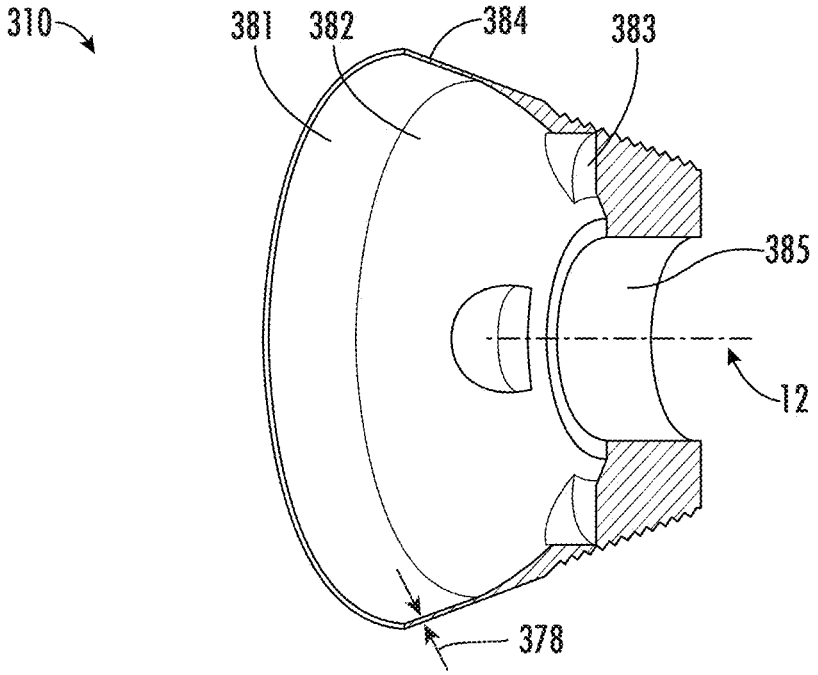
FIG. 23 is a cross-sectional isometric view of the locking ring.

FIG. 23 represents an isolated isometric cross-section view of the locking ring 310, over the center line 12. The same features as the ones described in FIG. 22 are visible. In particular, the first flared locking ring inner surface 381, the second flared locking ring inner surface 382, the flared locking ring outer surface 384. The thin section 378 between the first flared locking ring inner surface 381 and the flared locking ring outer surface 384 is represented in FIG. 23. Also visible is the one or several locking surfaces 383 and the trough hole 385.

Figure 24:
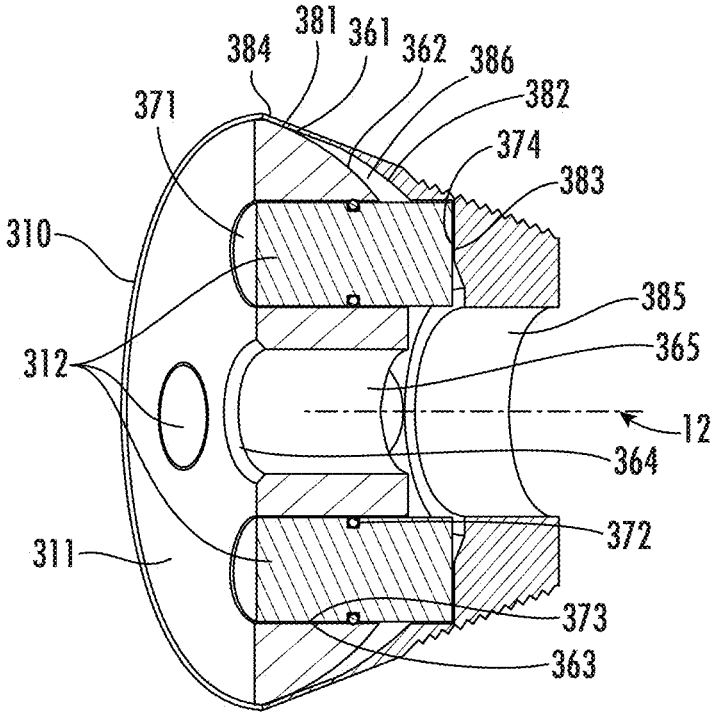
FIG. 24 is a cross-sectional isometric view of the combination of the locking ring, the hemispherical cup and three visible studs.

FIG. 24 represents an isometric cross-section view of the combination of the locking ring 310, the hemispherical cup 311 and the studs 312, over the center line 12.

FIG. 24 represents the configuration of the locking ring 310 the hemispherical cup 311 and the studs 312, as those parts would be interfering in an unset plug or just set plug configuration, as would previously be shown in FIGS. 6-10 or FIGS. 14-15. In this configuration, a longitudinal gap 386 may be present and not yet closed as would be the case in FIG. 12 or FIG. 16. The longitudinal gap 386 may be present between the second flared cup outer surface 362 of the hemispherical cup 311 and the second flared locking ring inner surface 382 of the locking ring 310. The studs 312 may be inserted inside the through-holes of the hemispherical cup 311, and inner surface 363 may be at the proximity of the outer surface 373 of the studs 312. The seal 372 may enhance the sealing capacity between those surfaces 363 and 373 and therefore potentially provide some pressure tightness, for fluid or gas, between the hemispherical cup 310 and the one or more studs 312. In this position, the end surface 374 of the studs 312 may be in contact with the stopping surface 383 of the locking ring 310, preventing a relative longitudinal movement towards each other parts.

The first flared cup outer surface 361 of the hemispherical cup 311 may match geometrically the conical lead angle, or the hemispherical lead profile of the first flared locking ring inner surface 381 of the locking ring 310. Also visible is the flared locking ring outer surface 384 of the locking ring 310, the through-hole 365 of the hemispherical cup 311 and the through-hole 385 of the locking ring 310. The end surface 371 of the studs 312 may be even or slightly prominent with the external front surface of the hemispherical cup 311. The position of the end surface 371 may allow the studs 312 to be in contact with the external mandrel 322 during the plug conveyance and setting as displayed in FIGS. 6 to 8.

Figure 25:
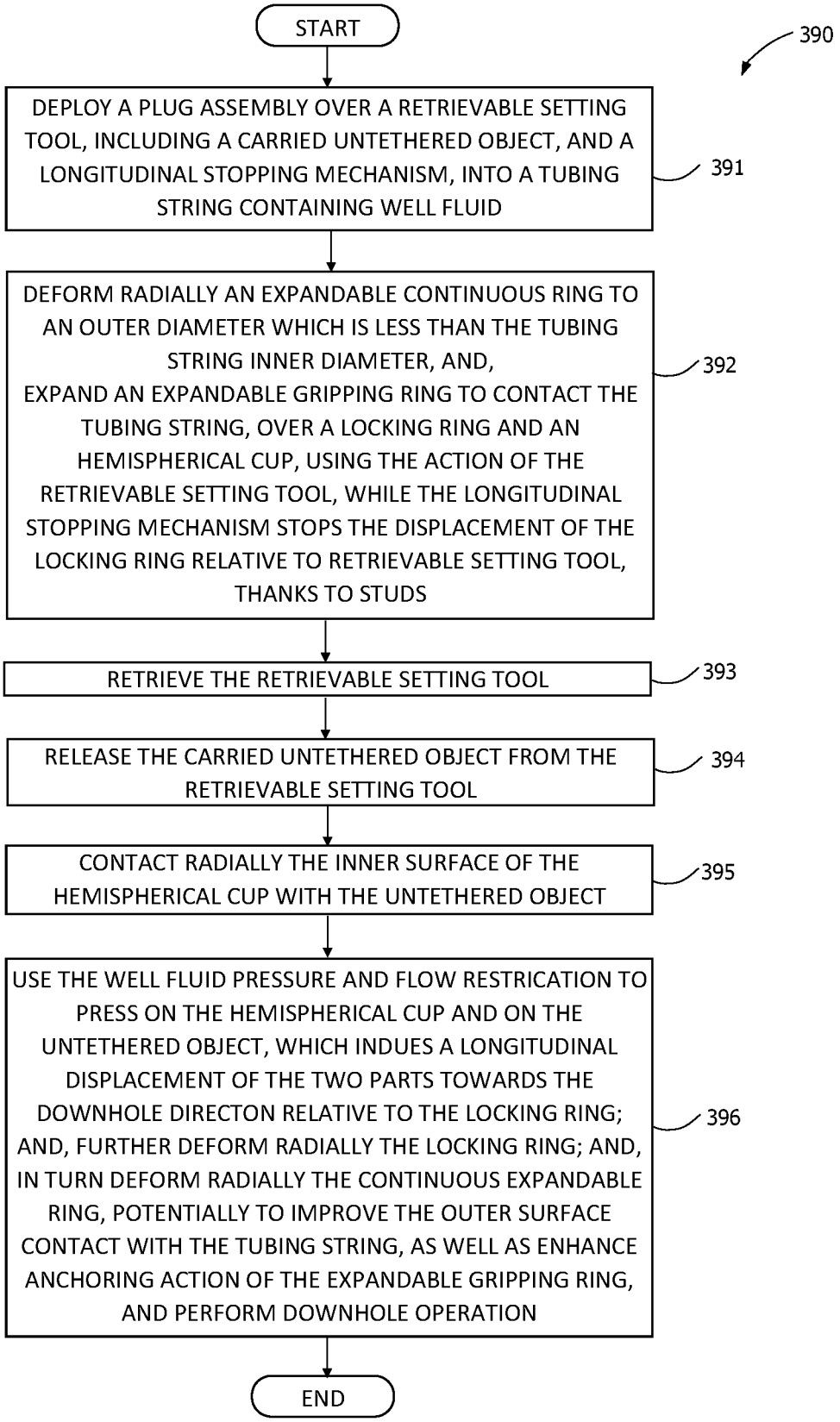
FIG. 25 is a flow diagram representing a technique sequence of deploying a ball-in-place plug activated by a cup and including studs.

FIG. 25 represents a technique sequence 390, which includes major steps described in FIG. 6 to FIG. 12.

Step 391 corresponds to the deployment of a plug assembly, as depicted in FIG. 6, over a retrievable setting tool, which may include an external mandrel 322 and an internal rod 321. The plug assembly includes a carried untethered object 313 and a longitudinal stopping mechanism, such as studs 312, as depicted in FIG. 6 to FIG. 24. The deployment of the plug assembly is occurring into a tubing string 1, which contains well fluid 2.

Step 392 corresponds of the setting of the plug assembly, using the action of the retrievable setting tool which includes parts 322 and 321. In particular step 392 includes the radial deformation of the expandable continuous seal ring 170 to an outer diameter which is less than the inner diameter of the tubing string 1. Step 392 also include the expansion of the expandable gripping ring 161 over the locking ring 310 and the hemispherical cup 311. During the expansion of the gripping ring 161 and the deformation of the expandable continuous seal ring 170, the longitudinal stopping mechanism, materialized with studs 312, is stopping the relative displacement of the locking ring relative to the retrievable setting tool and in particular relative to the external mandrel 322.

Step 393 corresponds to the retrieval of the retrievable setting tool, including parts 322 and 321.

Step 394 corresponds to the release of the carried untethered object 313 from the retrievable setting tool, typically from the external mandrel 322. Alternatively, the untethered object 313 may be released or launched from surface inside the tubing string.

Step 395 corresponds to the contact of the untethered object 313 with the receiving inner surface of the hemispherical cup 311.

Step 396 corresponds to the fluid further actuation of the set plug within the tubing string 1 and using well fluid 2. The pressure and flow restriction of the well fluid 2 may press on the hemispherical cup 311 and on the untethered object 313, which induces a longitudinal displacement and force of the two parts 311 and 313, towards the downhole direction, and relative to the locking ring 310. Further, the longitudinal displacement and force of the hemispherical cup 311 may induce the radial deformation of the locking ring 310, in particular the thin section 378 between surfaces 381 and 384 as depicted in FIG. 24. The radial deformation of the locking ring 310 induces in turn the radial deformation of the continuous expandable sealing ring 170, potentially to improve the outer surface contact of the continuous expandable sealing ring 170 with the inner surface of the tubing string 1, as well as enhance the anchoring action the contact and deformation of the expandable gripping ring 161. Further, a downhole operation may be performed.

What is claimed is:

1. A method comprising:

deploying a plug assembly, using a retrievable setting tool, into a tubing string containing well fluid, the plug assembly including:

an expandable assembly, comprising a continuous sealing portion and a gripping portion, a locking ring, a cup, wherein the retrievable setting tool includes an external mandrel and an internal rod, whereby the external mandrel includes a longitudinal stopping surface relative to the locking ring, wherein the expandable assembly includes a flared inner surface, wherein the locking ring includes a flared outer surface, a stopping inner surface relative to the cup, a longitudinal stopping surface relative to the external mandrel of the retrievable setting tool, and a flared portion, wherein the flared portion of the locking ring includes a flared inner surface positioned opposite of the flared outer surface, wherein the cup includes a flared outer surface, a stopping outer surface and a stopping inner surface, wherein the flared outer surface of the locking ring is contacting the flared inner surface of the expandable assembly, wherein the flared outer surface of the cup is contacting the flared inner surface of the locking ring, wherein the cup is configured for longitudinal displacement relative to the locking ring, and wherein the flared portion of the locking ring has the ability to deform radially outwards in response to longitudinal displacement of the cup relative to the locking ring due to the contact between the flared outer surface of the cup with the flared inner surface of the locking ring, wherein the stopping outer surface of the cup is adapted to couple with the stopping inner surface of the locking ring;

whereby one or multiple studs are positioned longitudinally between the longitudinal stopping surface of the locking ring relative to the external mandrel and the longitudinal stopping surface of the external mandrel relative to the locking ring, whereby the one or multiple studs provide the stopping movement of the locking ring relative to the external mandrel during the expansion of the expandable assembly;

expanding the expandable assembly over the flared outer surface of the locking ring, whereby the expandable assembly deforms radially until the gripping portion of the expandable assembly contacts at least one point of an internal surface of the tubing string, whereby the longitudinal stopping surface of the locking ring relative to the external mandrel and the longitudinal stopping surface of the external mandrel relative to the locking ring are stopped longitudinally relative to each other during the expansion of the expandable assembly.

2. The method of claim 1, whereby the longitudinal stopping surface of the locking ring relative to the external mandrel and the longitudinal stopping surface of the external mandrel relative to the locking ring are in direct contact with other during the expansion of the expandable assembly.

3. The method of claim 1, whereby the one or multiple studs slide longitudinally within the cup.

4. The method of claim 1, further comprising:

releasing an untethered object inside the well fluid of the tubing string, wherein the untethered object includes an outer surface adapted to couple with the stopping inner surface of the cup;

contacting the untethered object with the stopping inner surface of the cup, after the expandable assembly is deformed radially;

applying pressure on the untethered object and on the cup using the well fluid whereby forces are applied to the plug assembly to cause:

the radial deformation of the flared portion of the locking ring, the radial deformation of the continuous sealing portion of the expandable assembly, the contact of an internal surface of the tubing string with the continuous sealing portion of the expandable assembly, the longitudinal movement of the cup while contacting the flared inner surface of the locking ring until the stopping outer surface of the cup contacts the stopping inner surface of the locking ring; and penetrating the internal surface of the tubing string at the at least one point with the gripping portion of the expandable assembly.

5. The method of claim 4, further comprising diverting a portion of the well fluid outside the tubing string, or sealing a portion of the well fluid inside the tubing string with the plug assembly.

6. The method of claim 4, wherein radially deforming the expandable assembly occurs through plastic deformation of metallic alloy.

7. The method of claim 4, further comprising dissolving at least one component of the plug assembly or the untethered object.

8. The method of claim 4, wherein releasing the untethered object inside the well fluid occurs from surface or directly from the plug assembly as part of the plug assembly deployment inside the tubing string.

9. The method of claim 1, wherein the expandable assembly includes a continuous sealing ring and a gripping ring that are separate, wherein the continuous sealing ring and the gripping ring are coupled longitudinally through a conical or an annular contact surface, and wherein the inner surface of the continuous sealing ring and the inner surface of the gripping ring form the flared inner surface of the expandable assembly.

10. A plugging apparatus, for use inside a tubing string with a retrievable setting tool, containing well fluid, comprising:

the retrievable setting tool including:

an external mandrel and an internal rod, a plug assembly including:

an expandable assembly, comprising a continuous sealing portion and a gripping portion, a locking ring, a cup, one or multiple studs, wherein the expandable assembly includes a flared inner surface, wherein the locking ring includes a flared outer surface, a stopping inner surface relative to the cup, a longitudinal stopping surface relative to the external mandrel of the retrievable setting tool, and a flared portion, wherein the external mandrel includes a longitudinal stopping surface relative to the locking ring, wherein the flared portion of the locking ring includes a flared inner surface positioned opposite of the flared outer surface, wherein the cup includes a flared outer surface, a stopping outer surface and a stopping inner surface, wherein the flared outer surface of the locking ring is contacting the flared inner surface of the expandable assembly, wherein the flared outer surface of the cup is contacting the flared inner surface of the locking ring, wherein the stopping outer surface of the cup is adapted to couple with the stopping inner surface of the locking ring, wherein the flared inner surface of the expandable assembly is contacting the flared outer surface of the locking ring, wherein the expandable assembly is adapted to be deformed radially over the flared outer surface of the locking ring and wherein the cup is configured for longitudinal displacement relative to the locking ring, and wherein the flared portion of the locking ring has the ability to deform radially outwards in response to longitudinal displacement of the cup relative to the locking ring due to the contact between the flared outer surface of the cup with the flared inner surface of the locking ring;

wherein the one or multiple studs are positioned longitudinally between the longitudinal stopping surface of the locking ring relative to the external mandrel and the longitudinal stopping surface of the external mandrel relative to the locking ring, whereby the one or multiple studs provide the stopping movement of the locking ring relative to the external mandrel during the expansion of the expandable assembly.

11. The apparatus of claim 10, further comprising:

an untethered object, wherein the untethered object includes an outer surface adapted to couple with the stopping inner surface of the cup and, using well fluid pressure, to apply forces to the plug assembly to cause:

the radial deformation of the flared portion of the locking ring, the radial deformation of the continuous sealing portion of the expandable assembly, the contact of an internal surface of the tubing string with the continuous sealing portion of the expandable assembly, the longitudinal movement of the cup while contacting the inner surface of the locking ring until the stopping outer surface of the cup contacts the stopping inner surface of the locking ring, and the penetration of the internal surface of the tubing string at least at one point with the gripping portion of the expandable assembly;

whereby the one or multiple studs slide longitudinally within the cup.

12. The apparatus of claim 11, wherein the expandable assembly comprises one or more plastically deformable metallic alloys.

13. The apparatus of claim 11, wherein at least one component of the plug assembly or the untethered object comprise a material dissolvable inside the well fluid.

14. The apparatus of claim 11, further comprising a back-pushing ring, wherein the retrievable setting tool is adapted to displace the back-pushing ring causing the radial deformation of the expandable assembly over the flared outer surface of the locking ring, wherein the rod couples to the back-pushing ring with a preset load-shearing device.

15. The apparatus of claim 11, wherein the untethered object is included inside the retrievable setting tool, wherein the untethered object is launched from the retrievable setting tool after the radial expansion of the expandable assembly and before the retrieval of the retrievable setting tool.

16. The apparatus of claim 11, wherein the flared portion of the locking ring between the flared outer surface of the locking ring and the flared inner surface of the locking ring is a thin section, including a material capable of deforming radially, elastically or plastically, between 1% and 30%, under the forces applied by the cup and the untethered object to the plug assembly, upon the well fluid being pressurized between 100 psi and 20,000 psi [0.7 MPa to 138 MPa].

17. The apparatus of claim 16, wherein the thin section includes a radial thickness between 0.01 inch to 0.5 inch [0.2 mm to 12.7 mm].

18. The apparatus of claim 10, wherein the expandable assembly includes a continuous sealing ring and a gripping ring that are separate, wherein the continuous sealing ring and the gripping ring are coupled longitudinally through a conical or an annular contact surface, wherein an inner surface of the continuous sealing ring is adjacent to an inner surface of the gripping ring, and wherein the inner surface of the continuous sealing ring and the inner surface of the gripping ring form the flared inner surface of the expandable assembly.

* * * * *